US012042017B2

(12) United States Patent
Hopkins et al.

(10) Patent No.: US 12,042,017 B2
(45) Date of Patent: Jul. 23, 2024

(54) QUICK-PULL SHOE CLOSURE

(71) Applicant: NIKE, Inc., Beaverton, OR (US)

(72) Inventors: Timothy P. Hopkins, Lake Oswego, OR (US); Aaron B. Weast, Portland, OR (US); Peter P. Williams, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 106 days.

(21) Appl. No.: 17/489,617

(22) Filed: Sep. 29, 2021

(65) Prior Publication Data

US 2022/0015508 A1 Jan. 20, 2022

Related U.S. Application Data

(62) Division of application No. 15/797,945, filed on Oct. 30, 2017, now Pat. No. 11,147,345.
(Continued)

(51) Int. Cl.
*A43C 11/00* (2006.01)
*A43C 1/06* (2006.01)
(Continued)

(52) U.S. Cl.
CPC ..... *A43C 11/008* (2013.01); *A43C 1/06* (2013.01); *A43C 3/00* (2013.01); *A43C 11/12* (2013.01); *A43C 11/22* (2013.01)

(58) Field of Classification Search
CPC ..... A43C 11/008; A43C 11/12; A43C 11/22; A43C 1/06; A43C 3/00; A43C 7/08; A43C 7/02; A43B 23/26
(Continued)

(56) References Cited

U.S. PATENT DOCUMENTS 176,022 A 4/1876 Marsh
215,286 A 5/1879 Noack
(Continued)

FOREIGN PATENT DOCUMENTS

CN 101703333 A 5/2010
CN 202311536 U 7/2012
(Continued)

OTHER PUBLICATIONS

First Office Action mailed in Chinese Patent Application No. 201780081413.9, mailed on Oct. 12, 2020, 8 pages.
(Continued)

*Primary Examiner* — Katharine G Kane
(74) *Attorney, Agent, or Firm* — Klarquist Sparkman, LLP

(57) ABSTRACT

An article of footwear includes a medial support member coupled to a medial portion and having a first rail, a lateral support member coupled to a lateral portion and having a second rail, a plurality of lace-receiving members disposed on and movable along the first and second rails to move the article of footwear between an open configuration and a closed configuration, a lace member extending between the plurality of first lace-receiving members and the plurality of second lace-receiving members, a grip member extending from an upper-most first lace-receiving member of the plurality of first lace-receiving members or from an upper-most second lace-receiving member of the plurality of second lace-receiving members, and a locking member configured for securing the article of footwear in the closed configuration. The locking member has a first side portion and a second side portion forming a notch therebetween configured to receive the grip member.

19 Claims, 21 Drawing Sheets

Related U.S. Application Data

(60) Provisional application No. 62/532,842, filed on Jul. 14, 2017, provisional application No. 62/417,163, filed on Nov. 3, 2016.

(51) Int. Cl.
*A43C 3/00* (2006.01)
*A43C 11/12* (2006.01)
*A43C 11/22* (2006.01)

(58) Field of Classification Search
USPC ..... 36/50.1
See application file for complete search history.

(56) References Cited

U.S. PATENT DOCUMENTS 557,207 A 3/1896 Judson
996,468 A 6/1911 De Haven
1,020,511 A 3/1912 Ricks
1,196,216 A 8/1916 Doredant et al.
1,398,995 A 12/1921 Balthasar
1,408,563 A 3/1922 Leffingwell
1,798,471 A 3/1931 Janke
2,139,315 A * 12/1938 Partin ..... A43C 7/08 24/712.9
2,243,737 A 5/1941 Gioseph
2,268,003 A 12/1941 George
2,690,603 A 10/1954 Josef
2,814,085 A 11/1957 Herman
2,867,878 A 1/1959 Gideon
3,316,870 A 5/1967 Burbank
3,328,857 A 7/1967 Burbank
4,507,878 A 4/1985 Semouha
4,628,622 A 12/1986 McBarron
4,870,761 A 10/1989 Tracy
5,040,274 A 8/1991 Keech
5,371,957 A 12/1994 Gaudio
5,996,256 A 12/1999 Zebe, Jr.
6,018,890 A 2/2000 Bowen
6,049,955 A 4/2000 Bowen
6,173,509 B1 1/2001 Bowen
D441,522 S 5/2001 Matis et al.
6,243,971 B1 6/2001 Hofft
8,069,588 B2 12/2011 Rivas et al.
8,438,708 B1 * 5/2013 Tuck ..... A43C 7/005 36/1
9,615,624 B2 4/2017 Kilgore et al.
2006/0000116 A1 1/2006 Brewer
2007/0180730 A1 8/2007 Greene et al.
2008/0235987 A1 10/2008 Kaufman
2009/0172929 A1 7/2009 Jong
2011/0289742 A1 * 12/2011 Yen ..... A43C 1/04 24/68 SK
2012/0110870 A1 5/2012 Haouari
2012/0192461 A1 8/2012 Backus
2013/0180132 A1 7/2013 Settele
2014/0259761 A1 9/2014 Linth
2014/0325873 A1 11/2014 Linth
2016/0037863 A1 * 2/2016 Harley ..... A43C 7/005 36/72 R
2016/0206047 A1 7/2016 Hammerslag et al.
2017/0280817 A1 * 10/2017 Hutchinson ..... A43B 1/04
2017/0303632 A1 * 10/2017 Pratt ..... A43B 23/28
2018/0110296 A1 4/2018 Dombrow et al.

FOREIGN PATENT DOCUMENTS

DE 4216336 A1 11/1993
DE 19534091 A1 3/1997
EP 2255688 A1 12/2010
JP 2008/061901 A 3/2008
TW 201221077 A 6/2012
WO WO 1997/009894 A1 3/1997
WO WO 1997/009895 A1 3/1997
WO WO 00/047073 A2 8/2000
WO WO 2011/045645 A1 4/2011
WO WO 2011/147303 A1 12/2011
WO WO 2011/157050 A1 12/2011
WO WO 2017/175141 A1 4/2017

OTHER PUBLICATIONS

International Search Report and Written Opinion for corresponding International Application No. PCT/US2017/059059, mailed Jan. 2, 2018 (9 pages).

* cited by examiner 100
106
108
112
114
116
118
120
122
124
128
130
132
134
136
138
140
144
154
156

QUICK-PULL SHOE CLOSURE

CROSS REFERENCE TO RELATED APPLICATIONS

This application is a divisional of U.S. patent application Ser. No. 15/797,945, filed Oct. 30, 2017, which claims the benefit of U.S. Provisional Application No. 62/532,842, filed Jul. 14, 2017, and U.S. Provisional Application No. 62/417,163, filed Nov. 3, 2016. The related applications are incorporated by reference herein in their entirety.

FIELD

This disclosure relates generally to articles of footwear and, more specifically, to systems and methods for securing such articles of footwear to a wearer's foot.

BACKGROUND

Articles of footwear generally include a closure system, such as laces or straps, which allows a wearer's foot to be inserted into an article when the closure system is in an open configuration and which secures the wearer's foot within the article when the closure system is in a closed configuration. Despite widespread use, typical closure systems have their shortcomings, including being difficult to use, aesthetically unpleasant, non-customizable, and/or uncomfortable, to name a few. As such, improved closure systems are always desirable.

DETAILED DESCRIPTION

Figure 1:
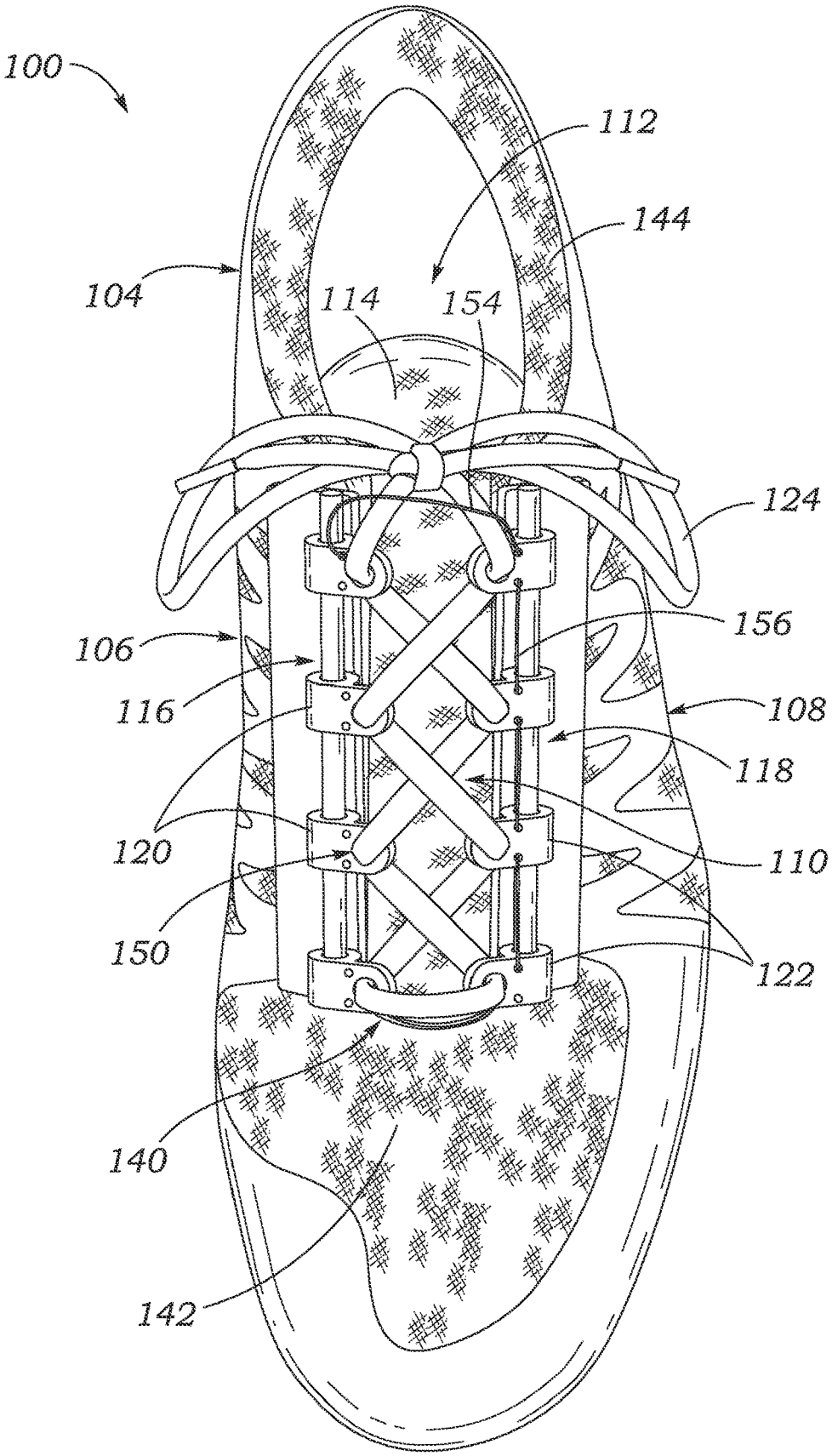
FIG. 1 is a top view of an exemplary embodiment of an article of footwear.

For purposes of this description, certain aspects, advantages, and novel features of the embodiments of this disclosure are described herein. The described methods, systems, and apparatus should not be construed as limiting in any way. Instead, the present disclosure is directed toward all novel and nonobvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present or problems be solved.

Features, integers, characteristics, or groups described in conjunction with a particular aspect, embodiment or example are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract, and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

The explanations of terms and abbreviations herein are provided to better describe the present disclosure and to guide those of ordinary skill in the art in the practice of the present disclosure. As used herein, "comprising" means "including" and the singular forms "a" or "an" or "the"

include plural references unless the context clearly dictates otherwise. The term "or" refers to a single element of stated alternative elements or a combination of two or more elements, unless the context clearly indicates otherwise.

As used herein, the term "and/or" used between the last two of a list of elements means any one or more of the listed elements. For example, the phrase "A, B, and/or C" means "A," "B," "C," "A and B," "A and C," "B and C," or "A, B, and C."

As used herein, the term "coupled" generally means physically coupled or linked and does not exclude the presence of intermediate elements between the coupled items absent specific contrary language.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the following detailed description and the claims.

Described herein are exemplary embodiments of articles of footwear and related components and methods. In some embodiments, an article of footwear comprises an adjustable closure system.

In one representative embodiment, an article of footwear comprises a medial portion, a lateral portion, a plurality of first lace-receiving members on the medial portion, and a plurality of second lace-receiving members on the lateral portion. One or more of the first and second lace-receiving members are movable along the respective medial and lateral portions from a first position to a second position.

In some embodiments, the article of footwear further comprises a medial support member coupled to the medial portion and a lateral support member coupled to the lateral portion. The first lace-receiving members are disposed on the medial support member and moveable relative to the medial support member, and the second lace-receiving members are disposed on the lateral support member and moveable relative to the lateral support member.

In some embodiments, the article of footwear further comprises a first grip member extending from at least one of the first lace-receiving members, and a second grip member extending from at least one of the second lace-receiving members.

In some embodiments, the first grip member includes a first knob coupled thereto, and the second grip member includes a second knob coupled thereto.

In some embodiments, the first grip member is coupled to and extends from an upper-most lace-receiving member of the first lace-receiving members, and the second grip member is coupled to and extends from an upper-most lace-receiving member of the second lace-receiving members.

In particular embodiments, the first position is an unsecured position and the second position is a secured position. The article of footwear further comprises a plurality of spacers that provide a predetermined amount of spacing between adjacent first or second lace-receiving members in the secured position.

In certain embodiments, the plurality of spacers comprises one or more flexible cords coupled to and extending between the adjacent first or second lace-receiving members.

In some embodiments, the first or second lace-receiving members comprise one or more apertures for receiving the plurality of spacers.

In some embodiments, the predetermined amount of spacing between at least one pair of adjacent first or second lace-receiving members in the secured position is different than the predetermined amount of spacing between at least one other pair of adjacent first or second lace-receiving members.

In some embodiments, the predetermined amount of spacing between adjacent first or second lace-receiving members in the secured position is substantially equal.

In some embodiments, the article of footwear further comprises one or more locking members configured to selectively secure the first and second lace-receiving members in the second position.

In particular embodiments, the one or more locking members comprise at least one projection configured for engaging the first or second grip members.

In some embodiments, the one or more locking members comprise at least one ridge configured for engaging the first or second grip members.

In some embodiments, the one or more locking members comprise a notch configured for receiving the first or second grip members.

In certain embodiments, the one or more locking members comprises a first side portion and a second side portion, and wherein the notch is disposed between the first side portion and the second side portion and is V-shaped.

In some embodiments, the medial and lateral support members each comprise a rail on which the respective first and second lace-receiving members are disposed.

In some embodiments, the first position allows a wearer's foot to be inserted into the article of footwear, and the second position secures the wearer's foot within the article of footwear.

In another representative embodiment, an article of footwear having a closure system comprises an elongate first rail, an elongate second rail spaced laterally from the first rail, a plurality of first movable members which are coupled to the first rail, a plurality of second movable members which are coupled to the second rail, and at least one lace member interconnecting the first and second movable members. One or more of the first and second movable members are adjustably movable relative to the first and second rails between a first position and a second position.

In some embodiments, a majority of the first and second movable members are disposed relatively closer to a throat of the article of footwear when the first and second movable members are in the first position than when the first and second movable members are in the second position.

In some embodiments, the article of footwear further comprises at least one locking member configured for selectively retaining the first movable members relative to the first rail.

In certain embodiments, the article of footwear further comprises a first locking member configured for selectively retaining the first movable members relative to the first rail, and a second locking member configured for selectively retaining the second movable members relative to the second rail.

In some embodiments, the locking member is configured to secure the first movable members in the second position.

In particular embodiments, the locking member is configured to secure the first movable members in one or more intermediate positions between the first position and the second position.

In some embodiments, the first and the second movable members comprise eyelets through which the lace member extends.

In some embodiments, the article of footwear further comprises a plurality of spacer members. The first and the second movable members comprise openings. The spacer members extend through the openings of the spacer members.

In another representative embodiment, a method of tightening an opening in an article of footwear is provided. The method comprises positioning a plurality of first movable lace-receiving members and a plurality of second movable lace-receiving members in a first position in which the first and second movable lace-receiving members have a first spacing relative to respective, elongate first and second rails to which the first and second movable lace-receiving members are coupled. At least one lace member interconnects the first and second movable lace-receiving members. The method further comprises moving the first and second movable lace-receiving members relative to the respective first and second rails from the first position to a second position in which the first and second movable lace-receiving members have a second spacing relative to the respective first and second rails. The second spacing is greater than the first spacing.

In some embodiments, the method further comprises locking the first movable lace-receiving members in the second position by actuating a locking member.

In some embodiments, actuating the locking member comprises securing a cord between first and second side portions of the locking member.

In certain embodiments, actuating the locking member comprises wedging a cord between two portions of the locking member.

In some embodiments, the cord is coupled to an uppermost one of the first movable lace-receiving members.

In particular embodiments, actuating the locking member includes pulling on a knob that is coupled to the cord.

It should be noted that an article of footwear can comprise shoes, boots, sandals, socks, and/or other types of footwear.

Although the examples described herein are primarily directed to articles of footwear, it should also be noted that the technology can be applied to various other applications. For example, the described technologies can be applied to other types of closures, including laced closures on clothing (e.g., pants, shorts, dresses), gloves, luggage, bags, etc.

Figure 2:
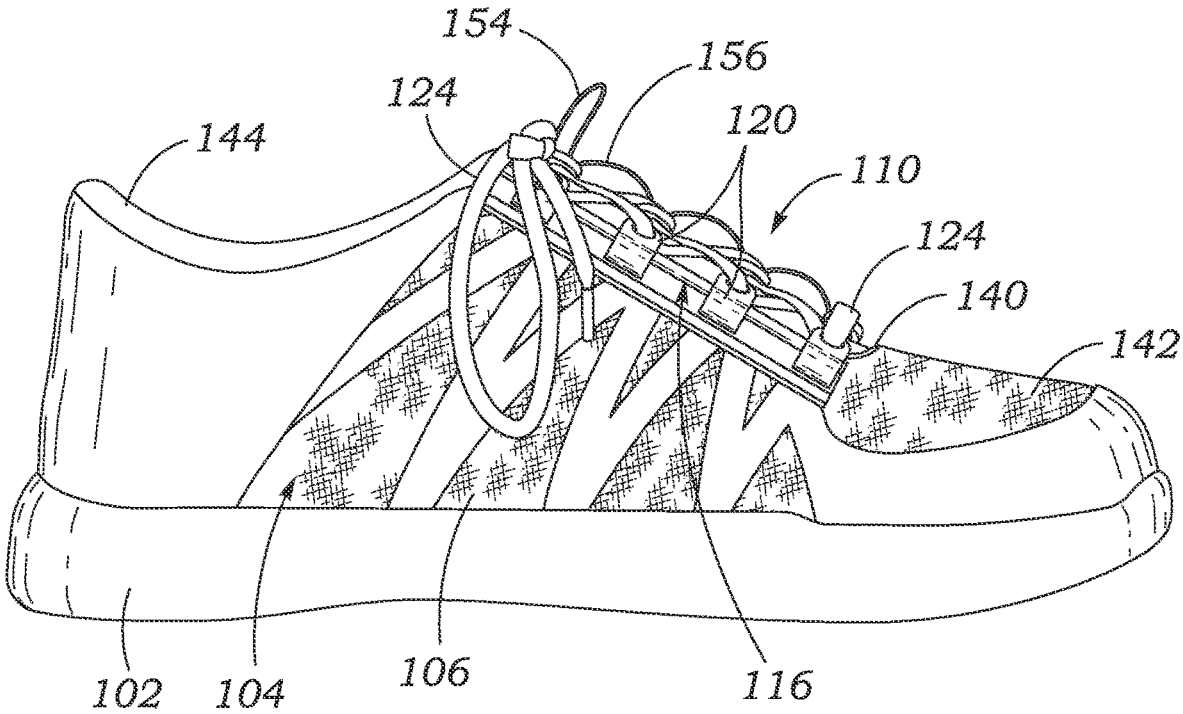
FIG. 2 is a medial side view of the article of footwear.
Figure 3:
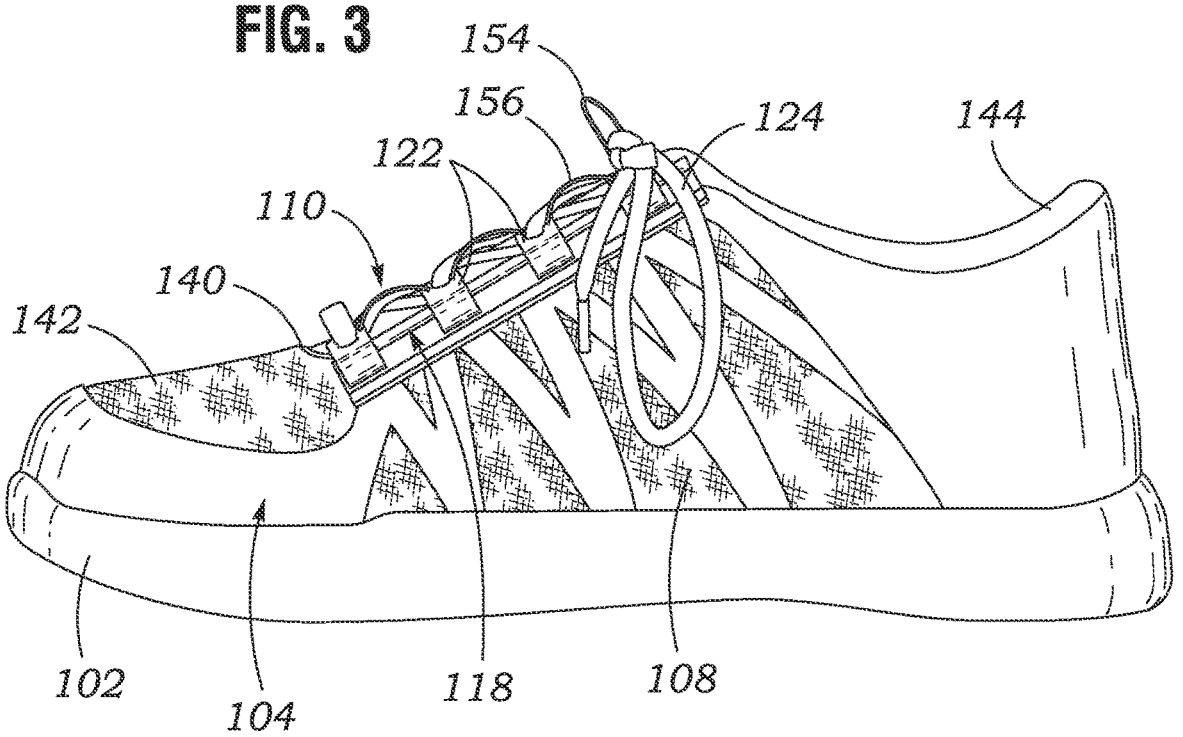
FIG. 3 is a lateral side view of the article of footwear.

FIGS. 1-3 illustrate an exemplary embodiment of an article of footwear ("article") 100. Although a single article is shown in the embodiments for purposes of clarity, embodiments may include a corresponding first article of footwear 100 and second article of footwear (not shown), configured for a left and right foot, respectively. Thus, it will be understood that the principles discussed herein may equally apply to another article of footwear corresponding to article of footwear 100.

The article 100 can comprise a sole structure 102 and an upper 104. In some embodiments, the sole structure 102 and the upper 104 can be formed as a single structure. In other embodiments, the sole structure 102 can be coupled to the upper 104, as shown, for example, in FIG. 2. The upper 104 can comprise a medial portion 106, a lateral portion 108, a closure system 110, and an opening 112. As shown in the illustrated embodiment, the closure system 110 can be coupled to and disposed between the medial and lateral portions 106, 108 (e.g., over a tongue 114 of the article 100). The closure system 110 is movable between a plurality of configurations or positions which expand or constrict the opening 112. This can, for example, allow a wearer's foot to be inserted into the article 100 and to be secured within the article 100, as further explained below.

Referring still to FIG. 1, the closure system 110 can comprise a first support member 116, a second support member 118, a plurality of first lace-receiving members 120 (e.g., four in the illustrated embodiment), a plurality of second lace-receiving members 122 (e.g., four in the illustrated embodiment), one or more lace members 124 (e.g., one in the illustrated embodiment), a grip member 154, and one or more spacer members 156. As discussed in more detail below, the grip member 154 can facilitate the adjustment of the position of the lace-receiving members by a wearer of the article, and the spacer members 156 can restrict relative movement of the lace-receiving members so that the lace-receiving members 120, 122 are spaced in a predetermined manner.

The first and second support members 116, 118 can be coupled to the medial and lateral portions 106, 108, respectively. In some embodiments, the first and second support members 116, 118 are disposed adjacent the tongue 114. The first and second lace-receiving members 120, 122 can be mounted on the respective first and second support members 116, 118.

The lace member 124 can be coupled to the first and second lace-receiving members 120, 122. The lace member 124 can also interconnect the first and second lace-receiving members 120, 122.

The grip member 154 can be coupled to at least some of the first and second lace-receiving members 120, 122 and/or the lace member 124.

The spacer member 156 can be coupled to at least some of the first and second lace-receiving members 120, 122 and/or the lace member 124.

Figure 5:
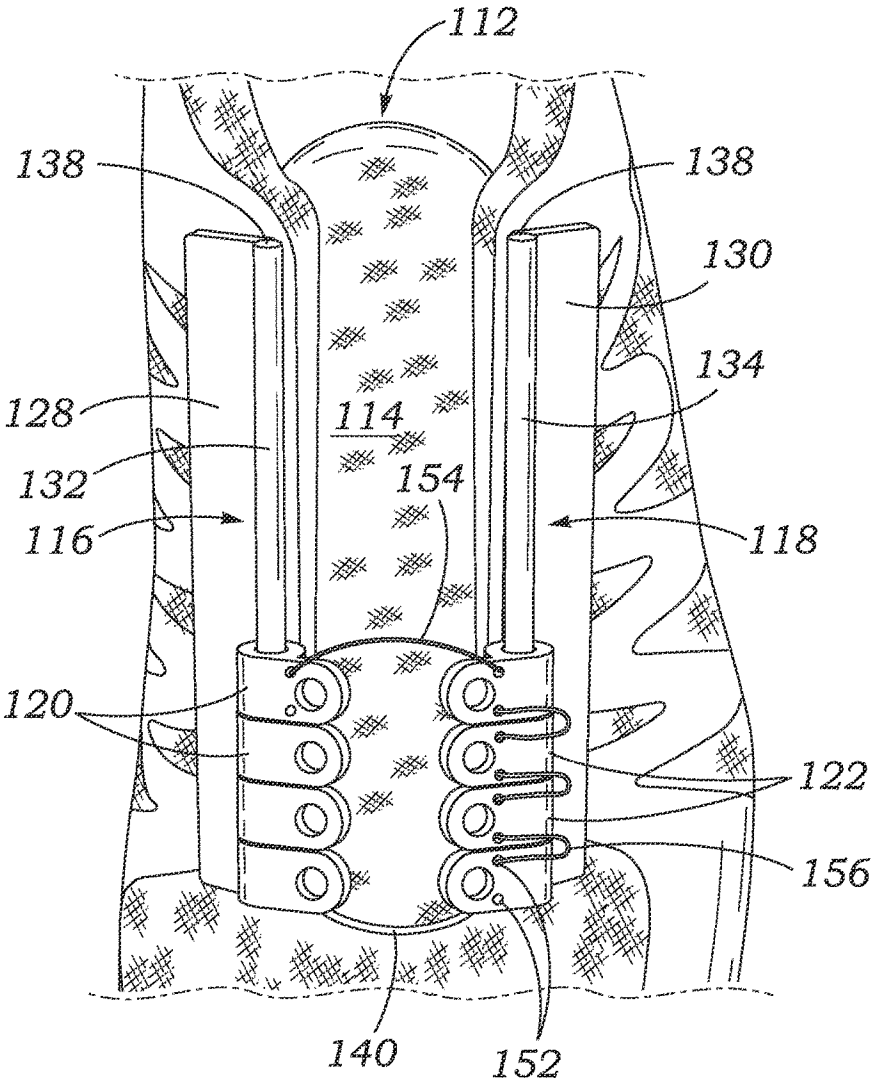
FIGS. 4-6 are various views of a closure system of the article of footwear.
Figure 4:
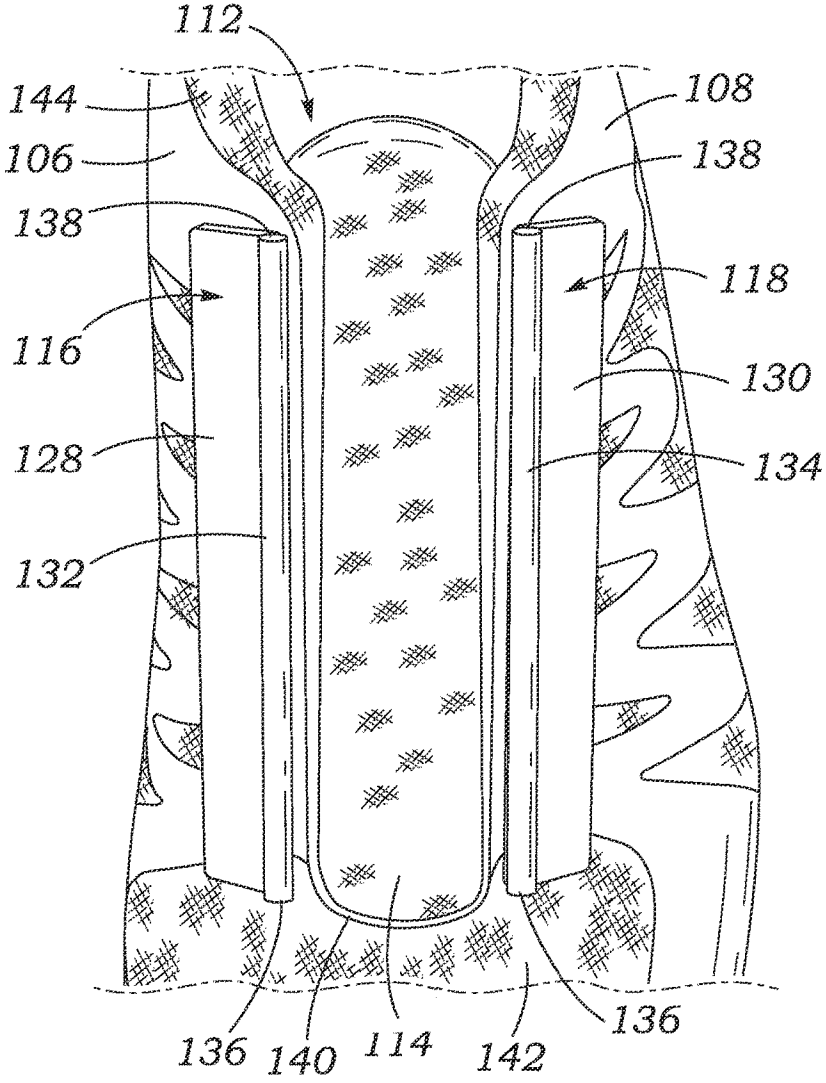
Figure 6:
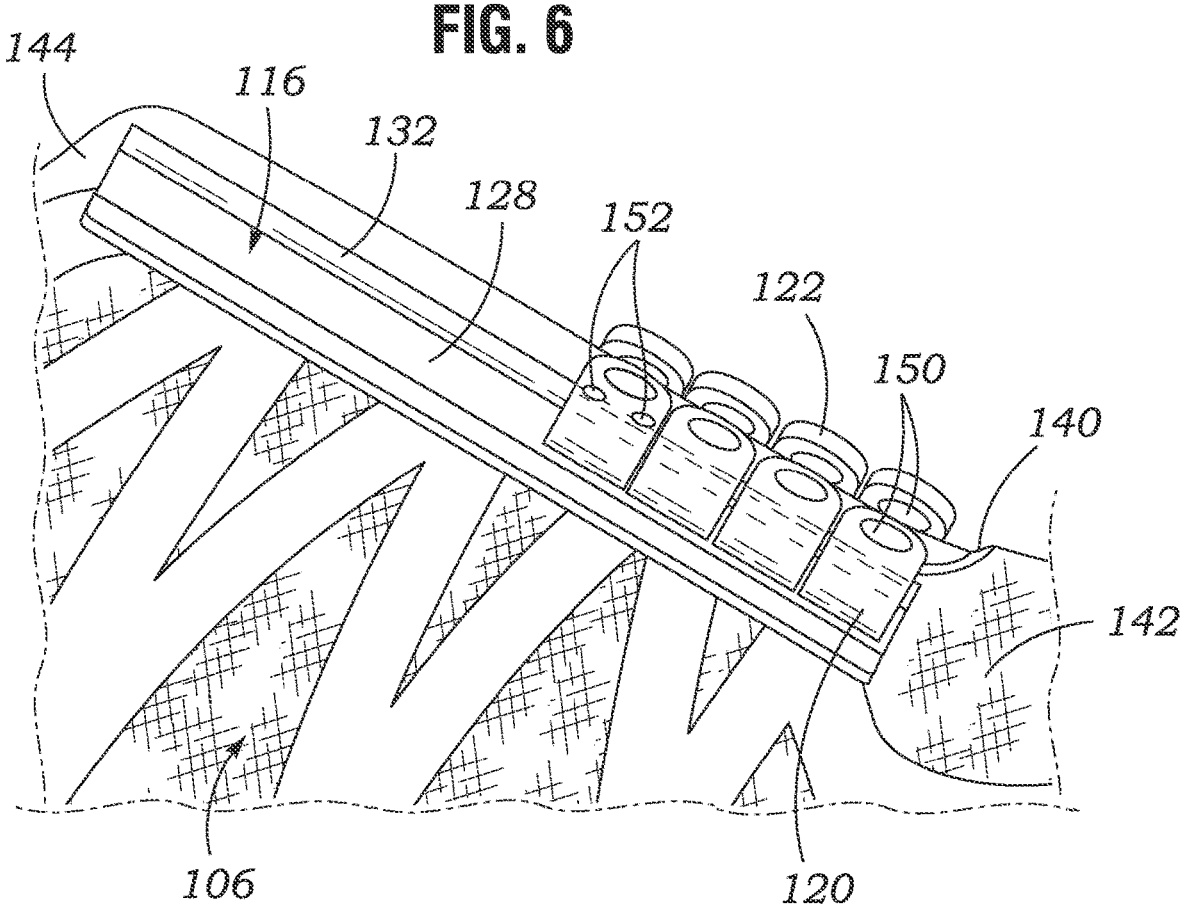

FIGS. 4-6 illustrate the article 100 with some of the components of the closure system 110 removed for clarity. Referring to FIG. 4, the first and second support members 116, 118 can comprise respective first and second base portions 128, 130 and first and second rails 132, 134. The first and second base portions 128, 130 can be coupled to the respective medial and lateral portions 106, 108, for example, with adhesive, fasteners, and/or stitching.

The first and second rails 132, 134 can be coupled to the respective first and second base portions 128, 130. As shown in the illustrated embodiment, the first and second rails 132, 134 can be coupled to the respective base portions 128, 130, for example, by integrally forming the base portions and the respective rails as single unitary pieces of material. In other embodiments, the first and second rails 132, 134 and the base portions 128, 130 can be coupled together with adhesive, fasteners, and/or stitching. In some embodiments, the base portions 128, 130 can be omitted, and the first and second rails 132, 134 can be coupled directly to the medial and lateral portions 106, 108, respectively, for example, with adhesive, fasteners, and/or stitching.

The first and second rails 132, 134 can extend longitudinally from first end portions 136 to second end portions 138. The first end portions 136 can be disposed adjacent a throat 140 (i.e., a portion where the tongue 114 is connected to a vamp portion 142 of the article 100) of the article 100. The second end portions 138 can be disposed adjacent a collar portion 144 (i.e. a portion at least partially surrounding the opening 112) of the article 100.

Figure 7:
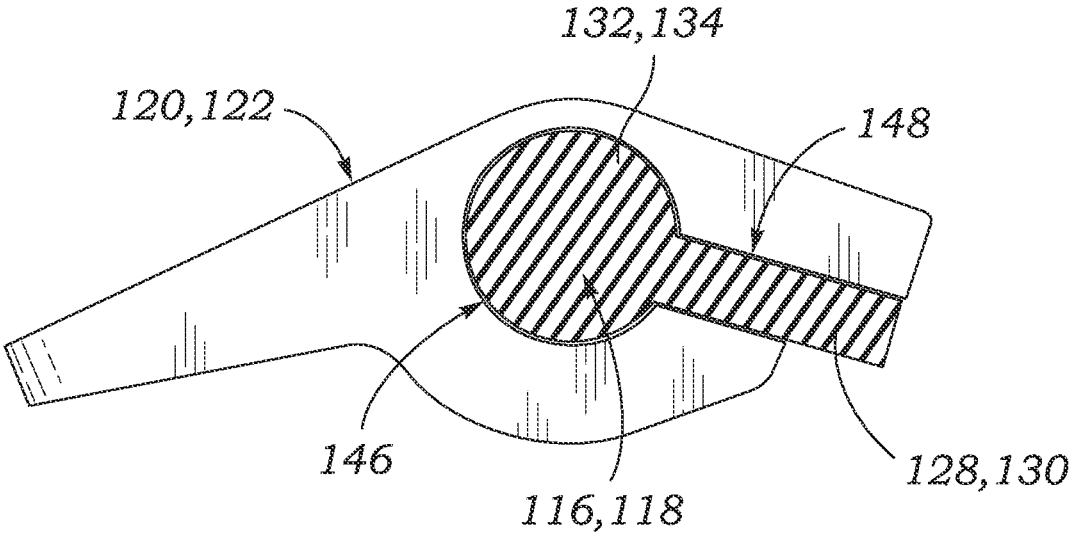
FIGS. 7-8 are various views of a lace-receiving member of the article of footwear.

In the illustrated embodiment, the first and second rails 132, 134 have circular cross-sectional shapes taken in a plane perpendicular to longitudinal axes of the first and second rails, as best shown in FIG. 7. In other embodiments, the first and second rails can comprise various other cross-sectional shapes including, ovular, rectangular, cruciform, T-shaped, etc.

Figure 8:
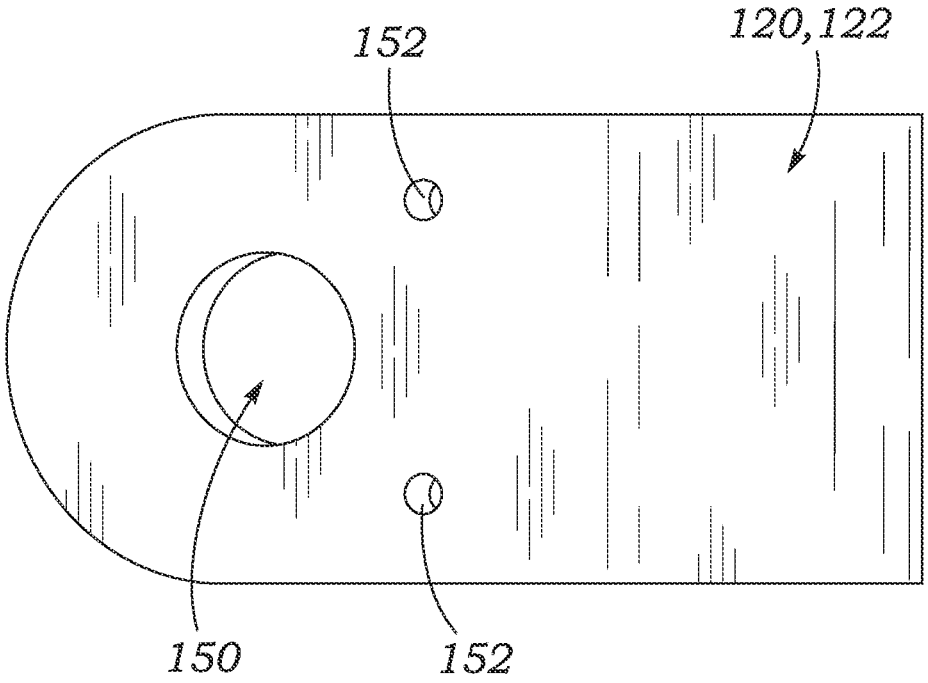

Referring to FIGS. 7-8, the first and second lace-receiving members 120, 122 can comprise openings 146, notches or grooves 148, lace receptacles 150, and apertures 152. The openings 146 can comprise a shape corresponding and/or complementary to the shape of the first and second rails 132, 134 (e.g., circular, ovular, rectangular, cruciform, T-shaped, etc.), as best shown in FIG. 7. In this manner, the openings 146 can be configured to receive the first and second rails 132, 134, thereby mounting the first and second lace-receiving members 120, 122 on the respective first and second support members 116, 118, as best shown in FIGS. 5-7. The grooves 148 can be configured to accommodate or receive the first and second base portions 128, 130, as best shown in FIG. 7. Referring to FIGS. 1 and 8, the lace receptacles 150 can comprise openings or eyelets (as shown, e.g., in the illustrated embodiment) and/or hooks configured to receive the lace member 124. Referring to FIGS. 5 and 8, the apertures 152 can be configured to receive one or more of the grip member 154 and/or the spacer member 156, as further described below.

Referring to FIGS. 4-5, at least some of the first and second lace-receiving members 120, 122 can be movable (e.g., slidable and/or rotatable) relative to the first and second support members 116, 118 and relative to each other. In some embodiments, each of the first and second lace-receiving members 120, 122 can be movable relative to the respective first and second support members 116, 118 and relative to each other. In other embodiments, some of the first and second lace-receiving members 120, 122 can be movable and some of the first and second lace-receiving members 120, 122 can be fixed relative to the respective first and second support members 116, 118. For example, a lowermost pair of the first and second lace-receiving members 120, 122 (i.e., the pair adjacent the throat 140) can be fixed relative to the first and second support members 116, 118 such that the lowermost pair of first and second lace-receiving members does not move when the closure system 110 is adjusted between the first and second configurations.

In some embodiments, the lace-receiving members 120, 122 can include features for reducing the friction with the lace member 124. For example, the lace-receiving members 120, 122 can include a pulley and/or other movable component that facilitates relative movement and/or reduces friction between the lace-receiving members 120, 122 and the lace member 124. In certain embodiments, the lace-receiving members 120, 122 can include a coating and/or a smooth surface to facilitate relative movement and/or reduce friction between the lace-receiving members 120, 122 and the lace member 124.

In some embodiments, the spacing between adjacent lace-receiving members 120, 122 can be adjusted to customize the tension of the lace member 124. For example, the spacing between adjacent lace-receiving members 120, 122 can be increased to increase the tension of the lace member 124 (e.g., for a more secure fit). The spacing between adjacent lace-receiving members 120, 122 can be decreased to decrease the tension of the lace member 124 (e.g., for a more relaxed fit).

Referring again to FIG. 1 and as mentioned above, the lace member 124 can extend through the lace receptacles 150 of the first and second lace-receiving members 120, 122. In some embodiments, the lace member 124 can be a single lace. In other embodiments, the lace member 124 can comprise a plurality of separate lace members. In such embodiments, each lace member can extend between a pair (e.g., an adjacent pair) of first and second lace-receiving members 120, 122. It should be noted that in FIG. 1 the lace member 124 is shown with some slack above the upper-most first and second lace-receiving members 120, 122 in order to better illustrate other aspects of the closure system 110. In use, however, the lace member 124 can have less (or no) slack in the second configuration, as shown, for example, in FIG. 11.

Referring to FIG. 5, the grip member 154 can be coupled to and extend between a pair (e.g., an adjacent pair) of first and second lace-receiving members 120, 122. For example, the grip member 154 can extend through the apertures 152 and be coupled to an upper-most pair of first and second lace-receiving members 120, 122 (i.e., the pair disposed farthest from the throat 140 in the configuration shown in FIG. 5). The grip member 154 can be formed of a relatively flexible or a relatively rigid material. The grip member 154 can be used to facilitate movement of the first and second lace-receiving members 120, 122, as further described below.

The spacer member 156 can be coupled to and extend between the first and/or second lace-receiving members 120, 122. For example, the spacer member 156 can extend through apertures 152 of each of the second lace-receiving members 122. In some embodiments, the spacer member 156 can comprise a plurality of spacer members. For example, a separate spacer member 156 can be coupled to and extend between adjacent first or second lace-receiving members 120, 122. For example, when there are four second lace-receiving members 122, there can be three spacer members 156.

The spacer member 156 can be formed from a flexible material (e.g., cord, string, wire, etc.). As such, the spacer member 156 can allow the first and second lace-receiving members 120, 122 to slide toward each other to a first configuration, as shown in FIG. 5. In the first configuration, the spacer member 156 is slack, thus causing the spacer member 156 to bend or flex.

The spacer member 156 can be sized to provide a predetermined amount of spacing between adjacent first or second lace-receiving members 120, 122 when the first and second lace-receiving members 120, 122 are moved relative to the support members 116, 118 from the first configuration (e.g., FIG. 5) to a spaced-apart, second configuration (e.g., FIG. 1). For example, a length of a portion of the spacer member 156 that is disposed between each adjacent first or second lace-receiving members 120, 122 can be selected to achieve a desired predetermined amount of spacing.

In some embodiments, for example, the length of the portion of the spacer member 156 that is disposed between each adjacent first or second lace-receiving members 120, 122 can be equal or substantially equal. As used herein, "substantially" means within plus or minus ten percent of the distance between the lace-receiving members. As such, the amount of spacing between each of the first or second lace-receiving members 120, 122 is equal or substantially equal in the second configuration.

In other embodiments, a length of the portion of the spacer member 156 that is disposed between one pair of adjacent first or second lace-receiving members 120, 122 can be unequal to or different than another pair of adjacent first or second lace-receiving members 120, 122. This results in unequal spacing between the first or second lace-receiving members 120, 122 in the second configuration.

Referring to FIG. 5, in some embodiments, the grip member 154 and the spacer member 156 can be formed from a single piece of material (e.g., string, cord, wire, etc.). In other embodiments, the grip member 154 and the spacer member 156 can be formed from separate pieces of material.

Figures 9, 10, 11:
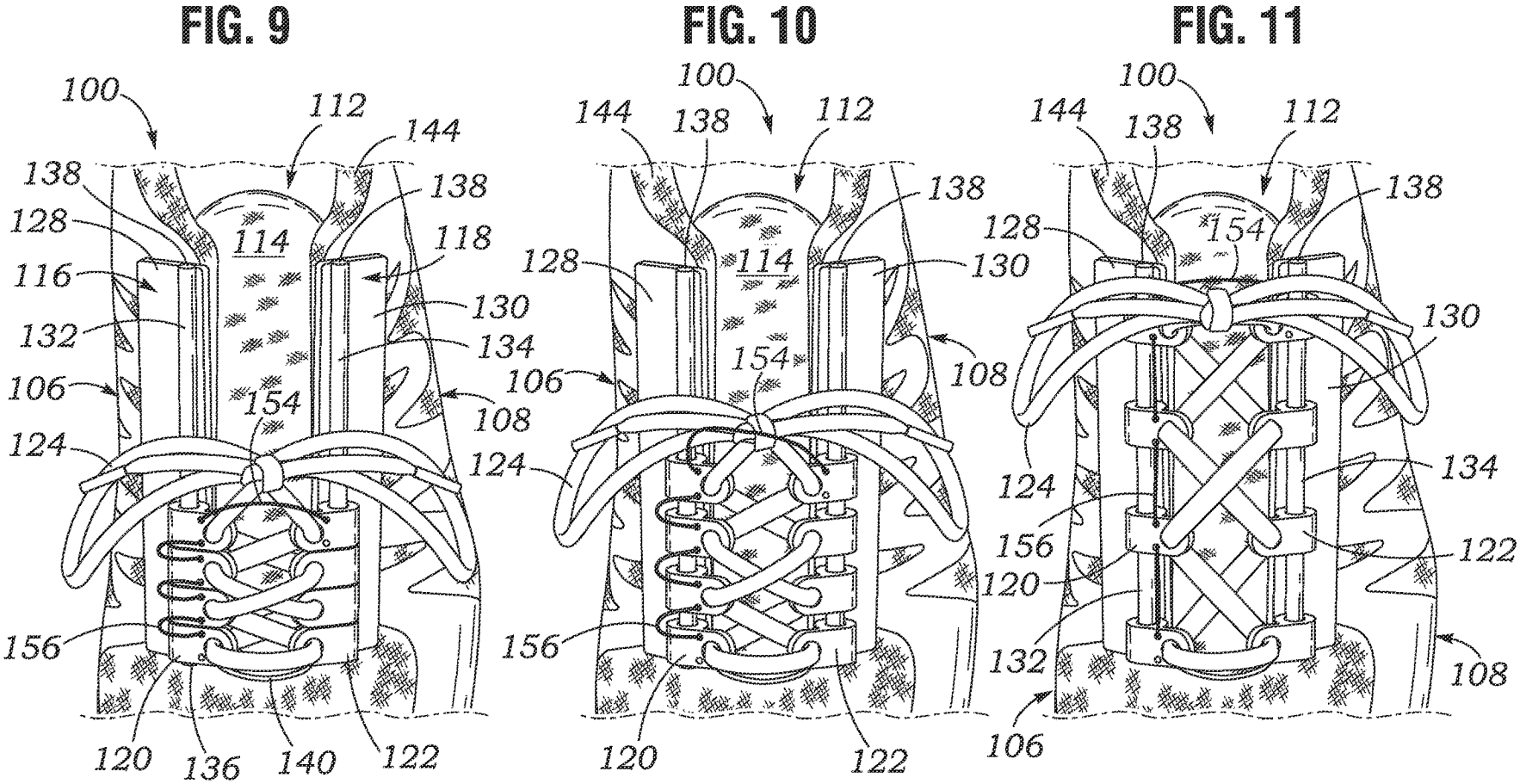
FIG. 9 is a top view of the closure system of the article of footwear, showing the closure system in an unsecured configuration.
FIG. 10 is a top view of the closure system of the article of footwear, showing the closure system in an intermediate or partially secured configuration.
FIG. 11 is a top view of the closure system of the article of footwear, showing the closure system in a secured configuration.

Configuring the closure system 110 in this manner can, for example, allow a wearer of the article 100 to put on and secure the article to the wearer's foot (not shown) in a relatively easy manner compared to typical closure systems, as illustrated, e.g., in FIGS. 9-11. FIG. 9 shows the closure system 110 in the first or unsecured configuration, FIG. 10 shows the closure system 110 an intermediate configuration, and FIG. 11 shows the closure system in the second or secured configuration.

The wearer can put on the article 100, for example, by moving the first and second lace-receiving members 120, 122 into the first configuration, as shown in FIG. 9. The wearer can accomplish this, for example, by grabbing and pushing the grip member 154 toward the throat 140 of the article 100. This causes the first and second lace-receiving members 120, 122 to slide relative to the respective first and second rails 132, 134 toward the first end portions 136 of the first and second rails 132, 134. It also causes the first and second lace-receiving members 120, 122 to move toward each other, reducing the space between the first and the second lace-receiving members 120, 122. In the first configuration, the first and second lace-receiving members 120, 122 and the lace member 124 are spaced from the collar portion 144 and compressed together, thus expanding the opening 112 and loosening the lace member 124 of the article 100. This allows the wearer to lift and/or pull the tongue 114 forward and easily insert a foot through the opening 112 and into an interior portion of the article 100.

The wearer can then secure or tighten the article 100 onto the foot, for example, by moving the first and second lace-receiving members 120, 122 from the first configuration to the second configuration, as shown in FIGS. 10-11. The wearer can accomplish this, for example, by grabbing and pulling the grip member 154 toward the collar portion 144 of the article 100. This causes the first and second lace-receiving members 120, 122 to slide relative to the respective first and second rails 132, 134 toward the second end portions 138 of the first and second rails 132, 134. As the first and second lace-receiving members 120, 122 move from the first configuration to the second configuration, the first and second lace-receiving members 120, 122 separate from each other, and the lace member 124 moves toward the collar portion 144. This causes the lace member 124 to tighten, thus contracting or constricting the opening 112 of the article 100 and securing the article 100 onto the wearer's foot.

In particular embodiment, intermediate configurations can be provided at one or more partially secured configurations between the first and second configurations. Such intermediate configurations can be useful, for example, when the wearer desires a secured article that can be more easily slid off the foot than when the closure system is in the fully-secured, second configuration.

The closure system 110 can also comprise one or more locking members configured to selectively secure the first and second lace-receiving members 120, 122 in the first, second, and/or intermediate configurations. In some embodiments, for example, the locking member can be formed by a frictional engagement between the first and second lace-receiving members and the respective first and second support members 116, 118. In other embodiments, one or more various other locking members can be used.

Figure 12:
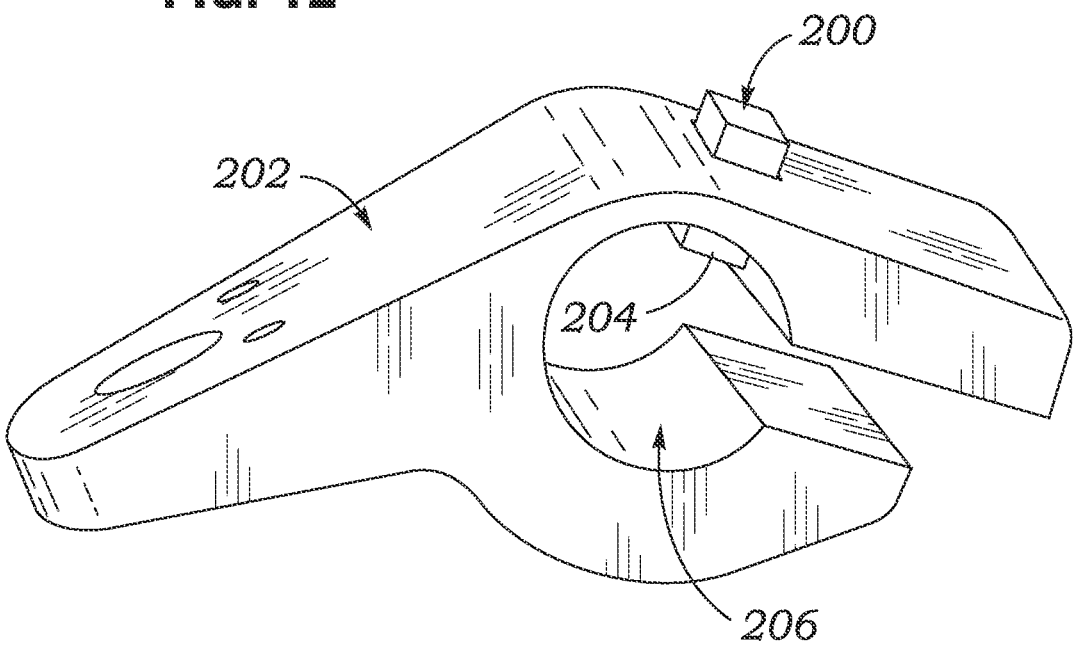
FIG. 12 is a perspective view of an exemplary locking member for a closure system.

FIG. 12 shows an exemplary embodiment of a locking member 200 that can be disposed on a lace-receiving member 202 (e.g., similar to the first and second lace-receiving members 120, 120). The locking member 200 can comprise a projection 204 extending into an opening 206 of the lace-receiving member 202. As such, the projection 204 can, for example, increase engagement between the lace-receiving member 202 and a rail member of a support member to which the lace-receiving member 202 is coupled. This increased engagement can selectively lock the lace-receiving member 202 in a predetermined location relative to the support member.

Figure 15:
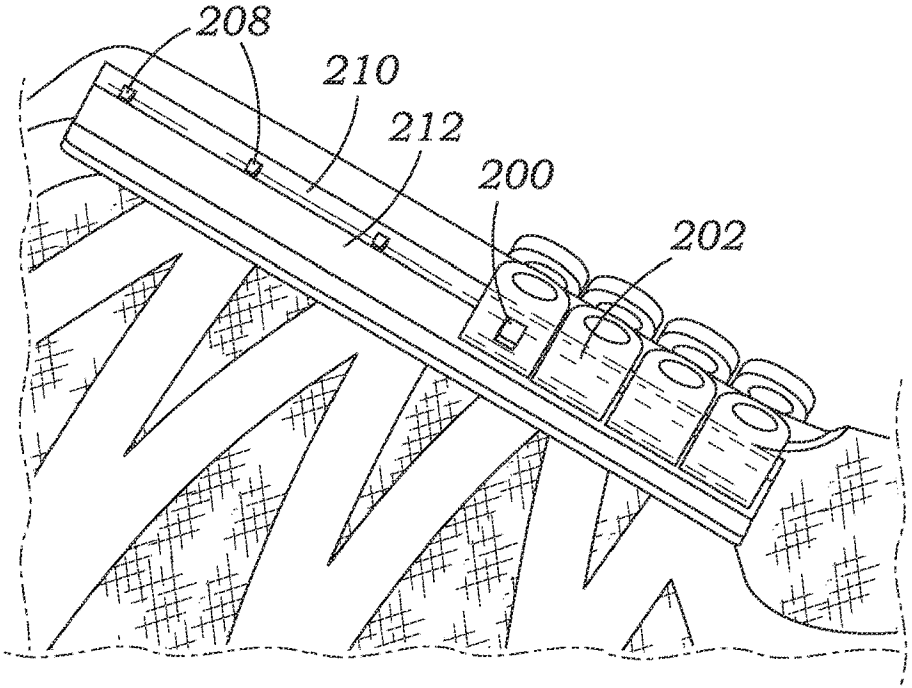
FIG. 15 is a side view of the locking member of FIG. 14.
Figure 14:
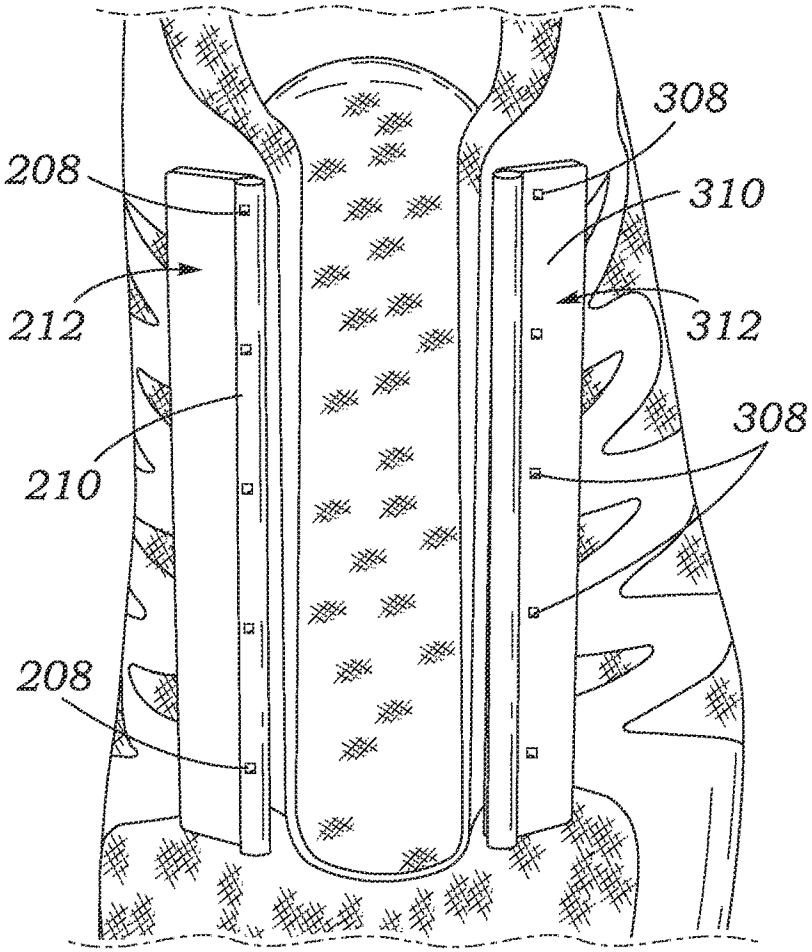
FIG. 14 is a top view of components of the locking members of FIGS. 12 and 13.

In some embodiments, the projection 204 can be configured to mate with one or more detents or recesses 208 (e.g., five in the illustrated embodiment) that are formed in a rail 210 of a support member 212, as shown in FIGS. 14 and 15. In this manner, the projection 204 causes the lace-receiving member 202 to more securely engage the rail 210 at the recesses 208 than at other locations along the rail 210.

In some embodiments, the locking member 200 can comprise a biasing element (e.g., a spring) configured to bias the projection 204 toward the support member 212. In some embodiments, the locking member 200 can comprise an actuator (e.g., a button) that can be actuated to bias the projection 204 toward the support member 212 in one configuration and/or to bias the projection away from the support member 212 in another configuration.

Figure 13:
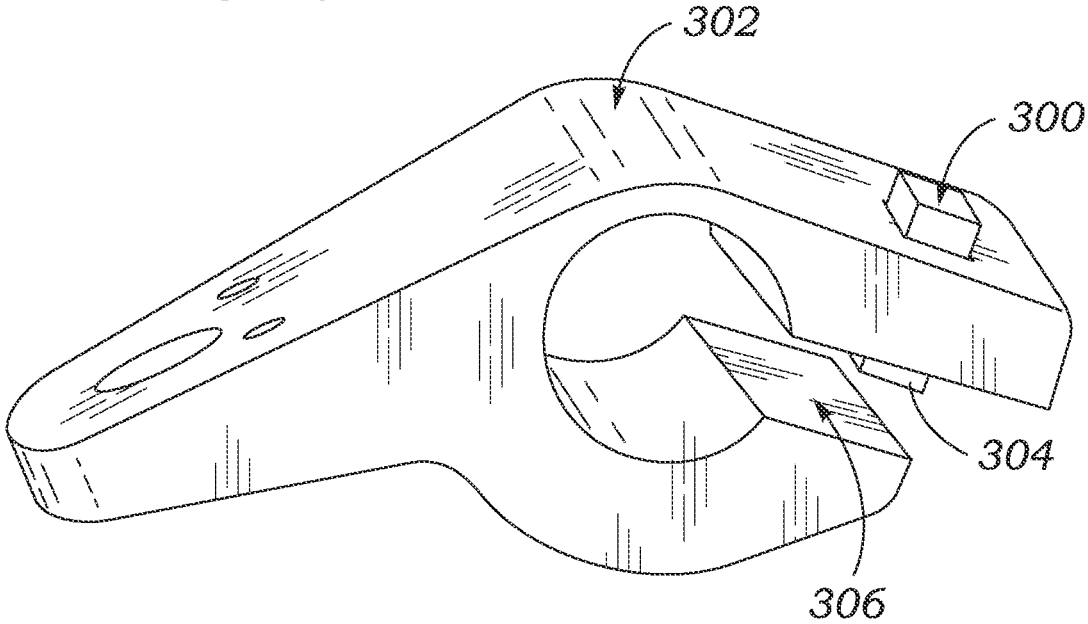
FIG. 13 is a perspective view of another exemplary locking member for a closure system.

FIG. 13 shows an exemplary embodiment of a locking member 300 that is disposed on a lace-receiving member 302 and configured in a manner similar to the locking member 200. The locking member 300 can comprise a projection 304 extending into a notch 306 of the lace-receiving member 302. The projection 304 can, for example, increase engagement between the lace-receiving member 302 and a base portion of a support member, thereby locking the lace-receiving member 302 in a predetermined location relative to the support member.

The projection 304 can be configured to mate with one or more detents or recesses 308 (e.g., five in the illustrated embodiment) that are formed in a base portion 310 of a support member 312, as shown in FIG. 14. In this manner, the projection 304 causes the lace-receiving member 302 to more securely engage the base portion 310 at the recesses 308 than at other locations along the base portion 310.

Figure 17:
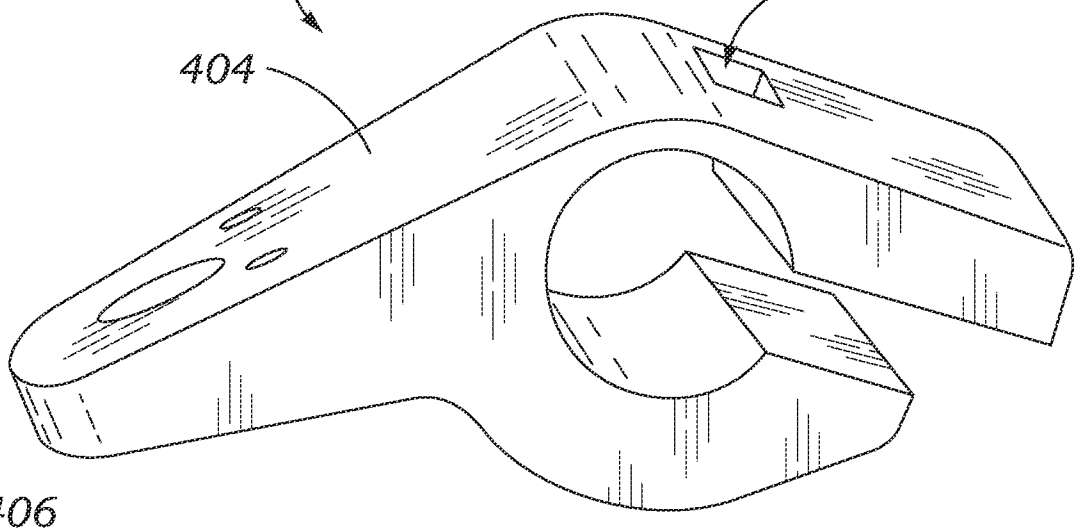
FIGS. 16-17 are various views of another exemplary locking member for a closure system.
Figure 16:
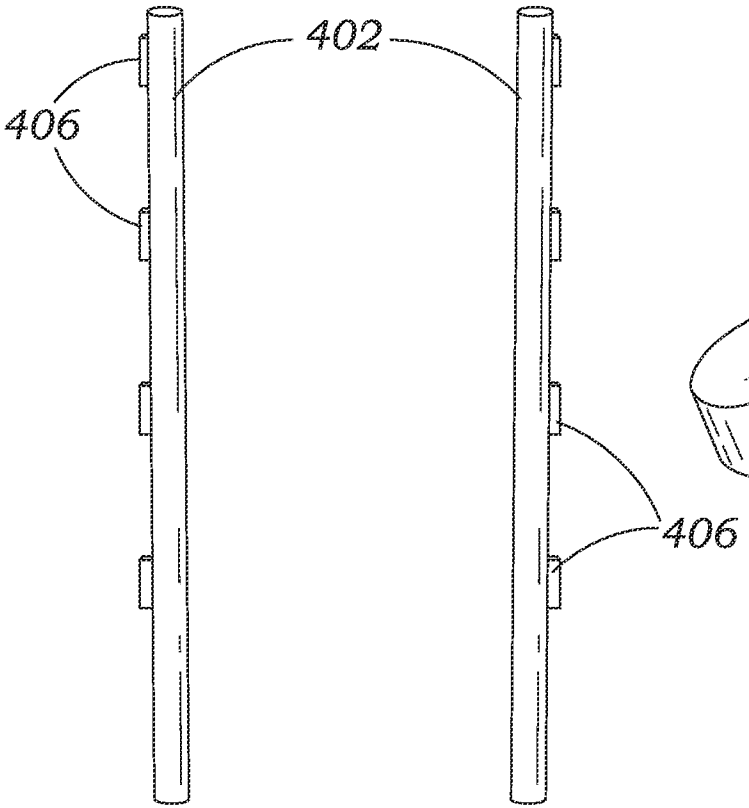

FIGS. 16-17 show an exemplary embodiment of a locking member 400. The locking member 400 can comprise rails 402 and lace-receiving members 404 (only one shown for purposes of illustration). The rails 402 can comprise one or more projections 406 configured to engage openings or recesses 408 on the lace-receiving members 404 to increase engagement between the lace-receiving members 404 and the rails 402, thereby locking the lace-receiving members 404 in a predetermined location relative to the rails 402.

Figure 18:
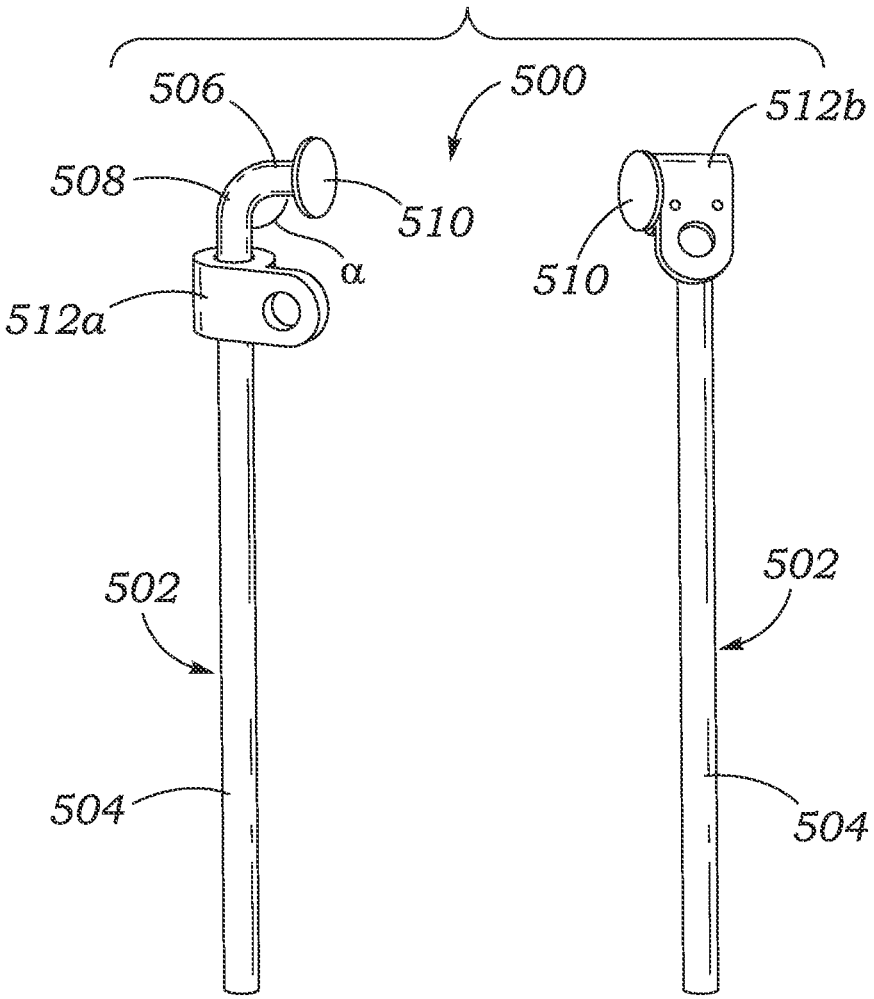
FIG. 18 is a perspective view of another exemplary locking member for a closure system.

FIG. 18 shows an exemplary embodiment a locking member 500. The locking member 500 can comprise rails 502. The rails 502 can each comprise first portions 504, second portions 506, and curved portions 508 disposed between the first and second portions 504, 506. The first portions 504 can, for example, be configured similar to the first and second rails 132, 134 of the article 100. The second portions 506 can comprise flange portions 510 configured to retain lace-receiving members 512*a*, 512*b* (collectively referred to as "lace-receiving members 512") on the rails 502. In some embodiments, the curved portion 508 can comprise an angle $\alpha$ less than or equal to 180 degrees, thereby providing an inflection to bias the lace-receiving members from moving relative to the rails 502 when in a secured configuration. In some embodiments, the angle $\alpha$ can be 45-135. In one particular embodiment, the angle α of the curved portion 508 can be 90 degrees.

Configuring the rails 502 in this manner causes the lace-receiving members 512 to rotate as the lace-receiving members 512 move from the first portions 504, around the curved portions 508, and onto the second portions 506. For example, the lace-receiving member 512*b*, which is disposed on the second portion 506, is rotated 90 degrees relative to the lace-receiving member 512*a*, which is disposed on the first portion 504. In the rotated configuration, the lace-receiving member 512*b*, is restricted from moving relative the first portion 504, thereby locking the lace-receiving member 512*b* in a predetermined location relative to the rails 502.

Although not shown, in other embodiments, the rails can comprise one or more grooves or slots that can allow lace-receiving members to be rotated relative to the rails, thereby locking the lace-receiving members relative to the rails in a manner similar to the locking member 500.

Figure 19:
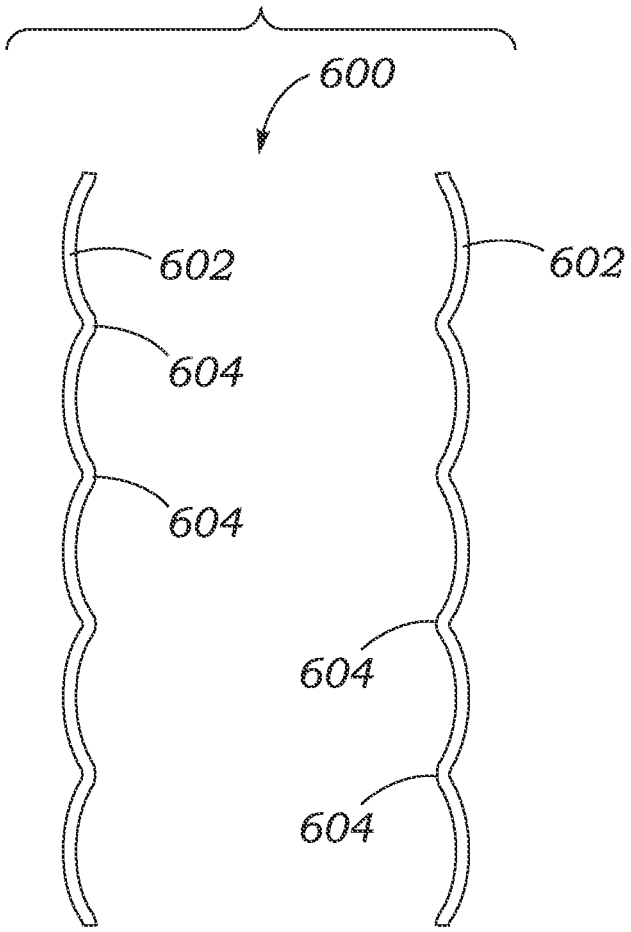
FIG. 19 is a perspective view of another exemplary locking member for a closure system.

FIG. 19 shows an exemplary embodiment of a locking member 600. The locking member 600 can comprise rails 602 having inflections 604 formed therein. As such, lace-receiving members (not shown) that are mounted on the rails 602 tend to move relatively easily along the rails 602 between the inflections 606 and to bind or stick at the inflections 606. Thus, the inflections 606 can be used to lock the lace-receiving members relative to the rails 602.

In some embodiments, an article can comprise multiple locking members and/or multiple embodiments of locking members (e.g., 200, 300, 400, 500, and/or 600). For example, the article 100 can comprise a first locking member on at least one of the first lace-receiving members 120 and a second locking member on at least one of the second lace-receiving members 122. In some embodiments, the locking member can be disposed on the upper-most lace-receiving member of an article.

Figure 20:
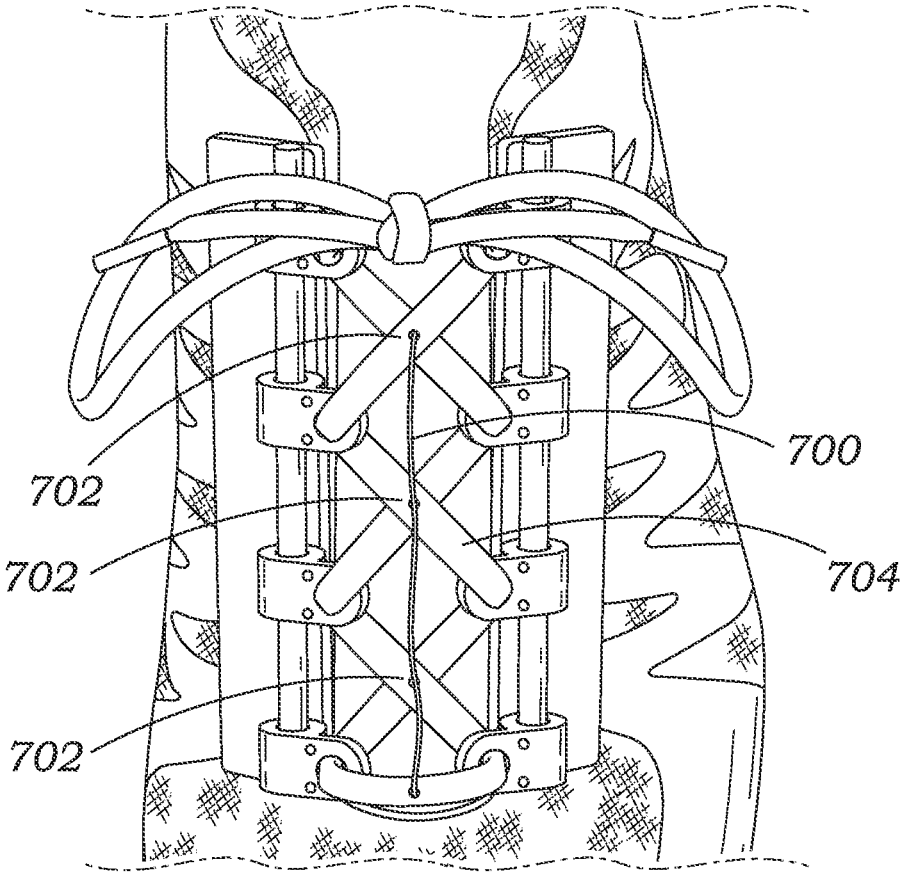
FIG. 20 is a top view of an exemplary spacer member for a closure system.

FIG. 20 shows an exemplary embodiment of a spacer member 700. The spacer member can be used in lieu of or in addition to the spacer member 156 (FIG. 1). The spacer member 700 can be coupled to a lace member 704, such as at intersections or crossings 702 as shown in the illustrated embodiment. Similar to the spacer member 156, the spacer member 700 can be configured to provide a predetermined amount of spacing between adjacent crossings 702 of the lace member 704 when the lace member is in a secured configuration (e.g., the configuration shown in FIG. 20).

Figure 21:
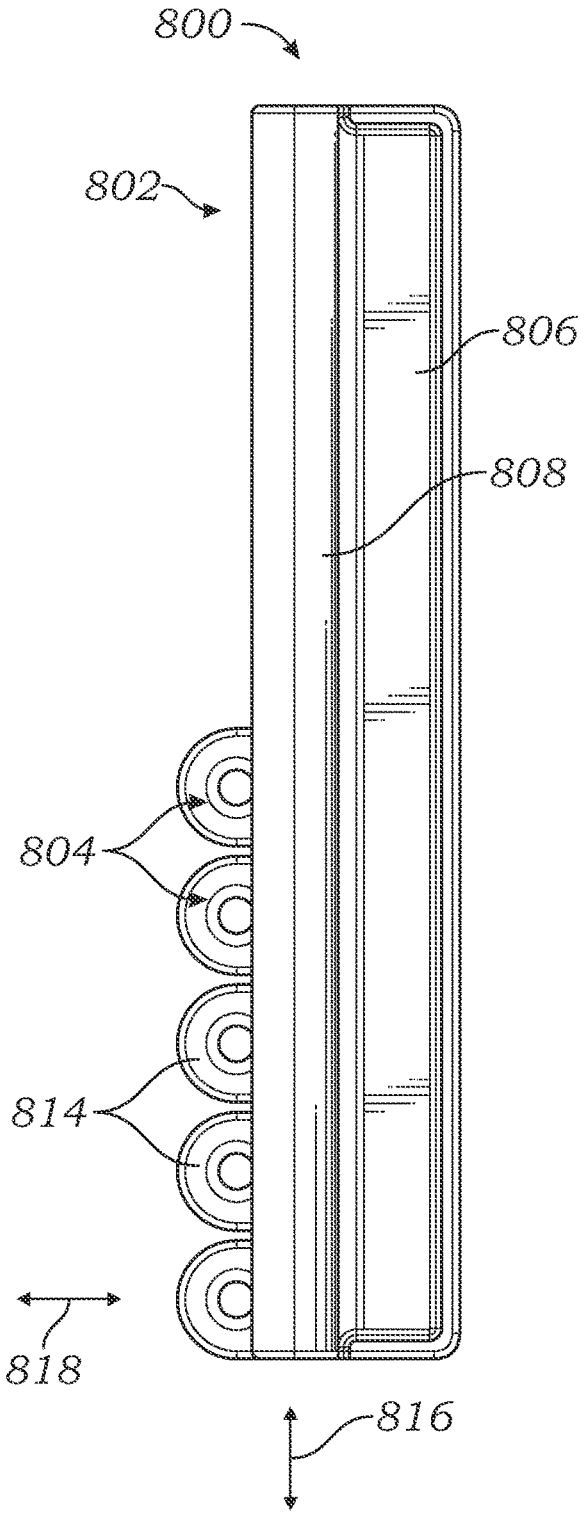
FIGS. 21-23 are various views of another exemplary closure system.
Figure 22:
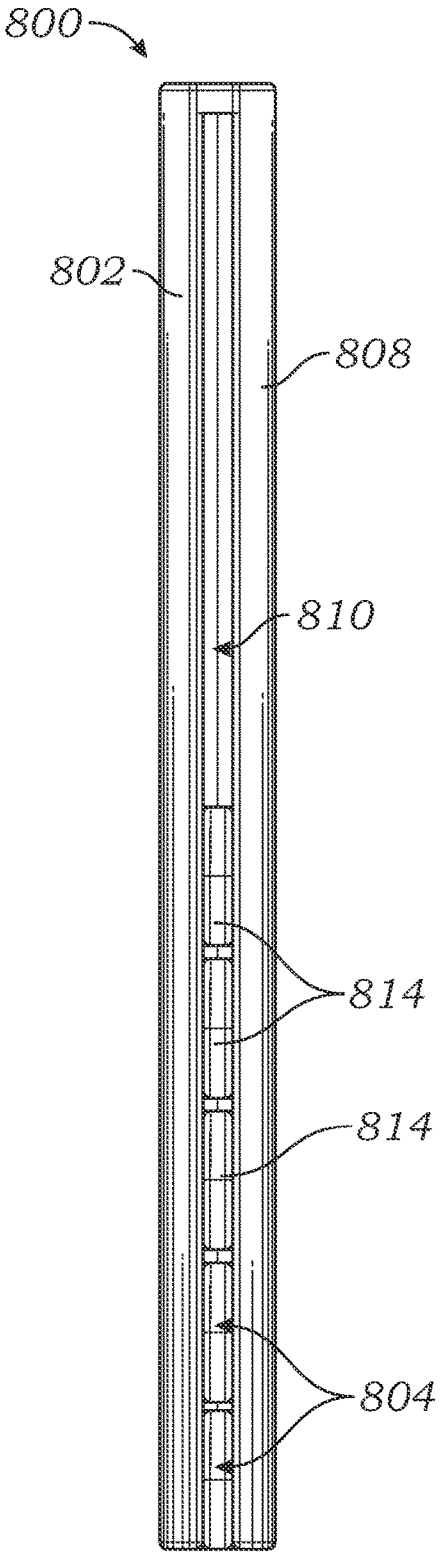
Figure 23:
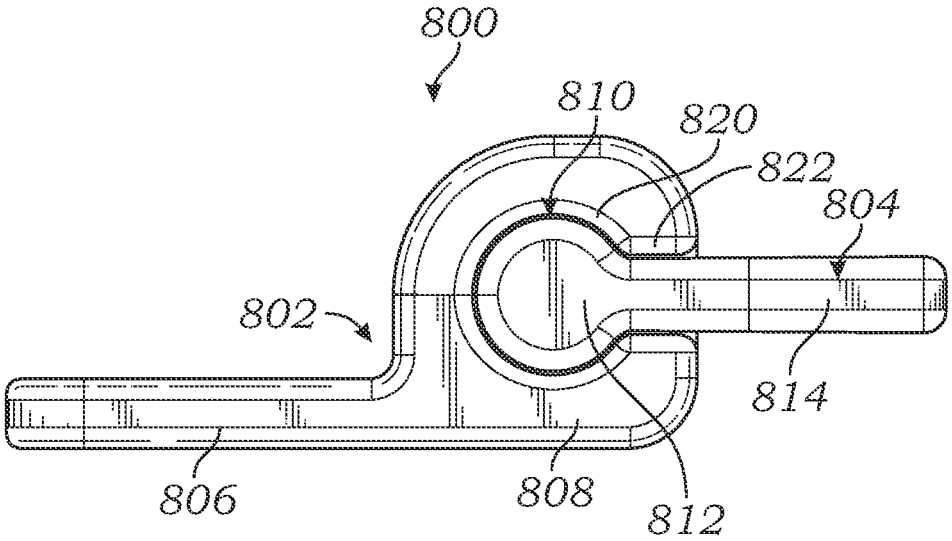

FIGS. 21-23 show an exemplary embodiment of a closure system 800, which can be used, for example, with an article of footwear. FIG. 21 shows a front view of the closure system 800. FIG. 22 shows a side view of the closure system 800. FIG. 23 shows an end view of the closure system 800.

Referring to FIG. 21, the closure system 800 can comprise one or more support members 802 (e.g., one shown for purposes of illustration) and one or more lace-receiving members 804 (e.g., five in the illustrated embodiment) movably coupled to the support member 802.

The support member 802 can include a base 806 and a guide 808. In some embodiments, the base 806 can, for example, be configured for coupling the closure system 800 to an upper of an article of footwear (e.g., to the medial and lateral sides of the upper adjacent a tongue of the article). The guide 808 can be coupled to the base 806 and can include a groove 810 configured for receiving the lace-receiving members 804.

Referring to FIG. 23, each of the lace-receiving members 804 can include a rail 812 and an eyelet 814 extending from the rail 812. The rails 812 of the lace-receiving members 804 can be disposed within the groove 810 of the guide 808, and the eyelets 814 of the lace-receiving members 804 can extend out of the groove 810.

The groove 810 of the guide 808 and the rails 812 of the lace-receiving members 804 can be coupled so that the lace-receiving members 804 can move (e.g., slide) axially (e.g., in the direction shown by arrow 816 in FIG. 21) relative to the groove 810, but lateral movement (e.g., in the direction shown by arrow 818 in FIG. 21) relative to the groove 810 is restricted. This can be accomplished in various ways. For example, referring again to FIG. 23, the groove 810 can comprise a generally C-shaped portion 820 (i.e., taken in a plane perpendicular to a longitudinal axis of the groove 810) and a slot 822 extending from the C-shaped portion 820. The rails 812 of the lace-receiving members 804 can be disposed in the C-shaped portion 820 of the groove 810, and the eyelets 814 of the lace-receiving members 804 can extend through the slot 822 of the groove 810. Therefore, because the rails 812 have a larger cross-sectional dimension than that defined by the slot 822, the guide 808 restricts lateral movement of the rails 812 relative to the groove 810.

The closure system 800 can include various other components. For example, the closure system 800 can include a grip member and/or one or more spacer members (e.g., similar to the grip member 154 and the spacer members 156 shown in FIG. 5). The closure system 800 can also comprise a locking member or mechanism configured to selectively retain the positon of the lace-receiving members 804 relative to the support member 802.

Figure 24:
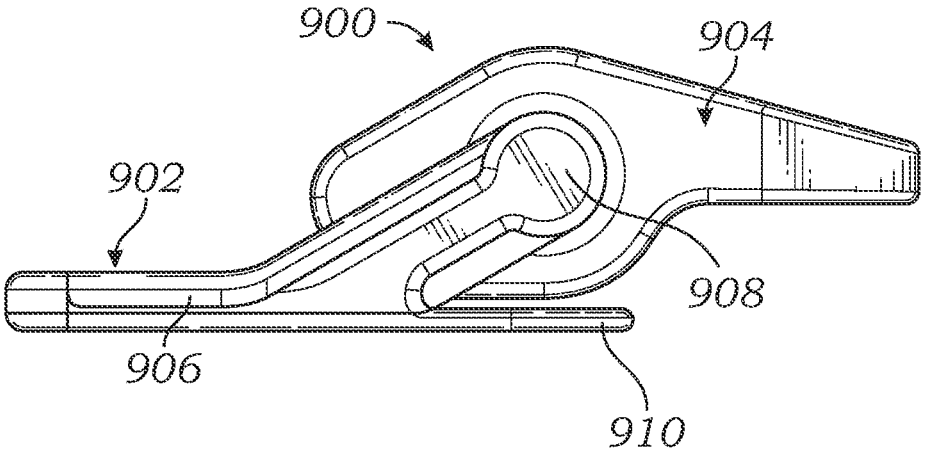
FIG. 24 is an end view of another exemplary closure system.

FIG. 24 shows an exemplary embodiment of a closure system 900, which can be used, for example, with an article of footwear. The closure system 900 can comprise one or more support members 902 (one shown for purposes of illustration) and a plurality of lace-receiving members 904 (one shown for purposes of illustration) movably (e.g., slidably) coupled to the support member 902. The support member 902 and the lace-receiving members 904 of the closure system 900 can, for example, be configured similar to the support members 116, 118 and the lace-receiving members 120, 122 of the closure system 110, respectively.

The support member 902 can include a base 906 and a rail 908. In some embodiments, the base 906 can, for example, be configured for coupling the closure system 900 to an upper of an article of footwear (e.g., adjacent a tongue of the article). The rail 908 can be coupled to and extend from the base 906. The rail 908 can be configured for receiving the lace-receiving members 904. As shown in FIG. 24, the lace-receiving members 904 have a portion (e.g., a C-shaped portion) that extends around at least a portion of the rail 908, thereby allowing the lace-receiving members 904 to slide relative to the rail 908, while restricting lateral movement of the lace-receiving members 904 relative to the rails 908.

In some embodiments, the support member 902 can also include a flange 910 extending (e.g., laterally) from the rail 908. As such, the flange 910 can be disposed between the lace-receiving members 904 and an upper and/or tongue of an article to which the closure system 900 is coupled. In this manner, the flange 910 can, for example, facilitate movement of the lace-receiving members 904 along the rail 908 by reducing frictional forces opposing movement of the lace-receiving members 904. For example, in some embodiments, the flange 910 (and/or the rail 908) can be formed from a material having a lower coefficient of friction (e.g., static and/or kinetic) than the material of an upper to which the base 906 is coupled. As such, to the extent the lace-receiving members 904 contact the flange 910, the lace-receiving members 904 can move more easily along the rail 908 than if the flange 910 were not present and the lace-receiving members 904 were directly contacting the upper and/or the tongue of the article.

In lieu of or in addition to the flange 910, an upper and/or a tongue of an article can be configured to facilitate movement between the lace-receiving members 904 and the rail 908. For example, material (e.g., textiles) of the upper and/or the tongue can be selected to reduce frictional forces on the lace-receiving members 904 caused by the lace-receiving members 904 contacting the upper and/or the tongue.

Figure 25:
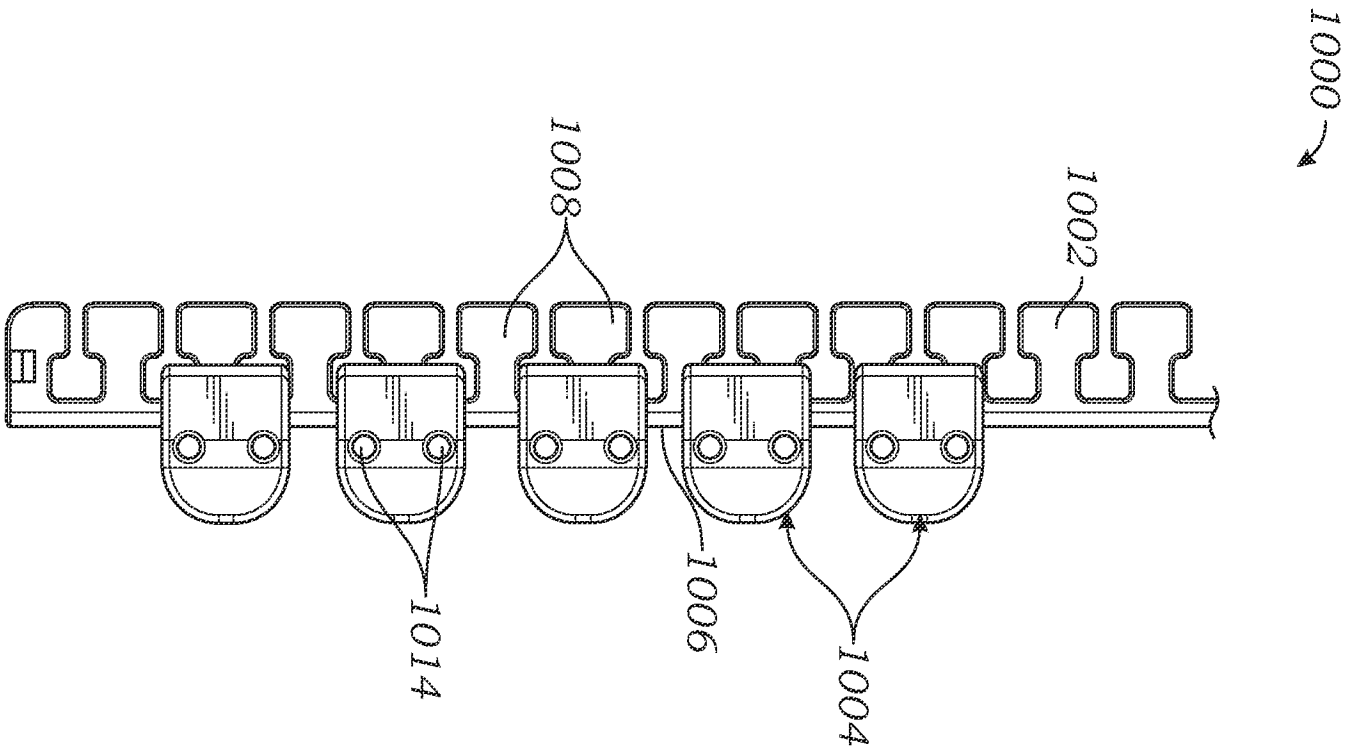
FIGS. 25-26 are various views of another exemplary closure system.
Figure 26:
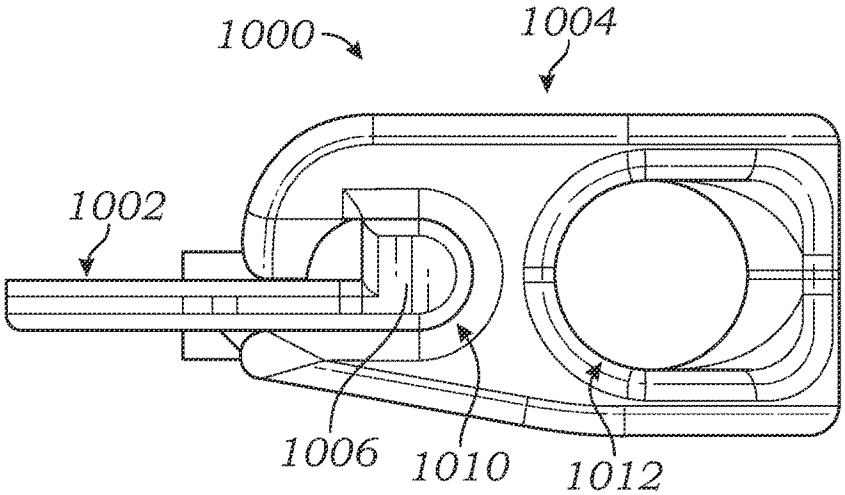

FIGS. 25-26 show an exemplary embodiment of a closure system 1000, which can be used, for example, with an article of footwear. Referring to FIG. 25, the closure system 1000 can comprise one or more support members 1002 (one shown for purposes of illustration) and plurality of lace-receiving members 1004 (e.g., five in the illustrated embodiment) movably (e.g., slidably) coupled to the support member 1002.

Referring still to FIG. 25, the support member 1002 can include a base and a rail 1006 coupled to the base. In some embodiments, the base can be configured similar to the tape portion of a zipper and can be used, for example, to secure the support member 1002 to an article. The rail 1006 can include a plurality of spaced segments 1008 configured similar to the teeth portion of a zipper.

Referring to FIG. 26, each of the lace-receiving members 1004 can include a groove 1010 and an eyelet 1012. The grooves 1010 can be configured for receiving the rail 1006 of the support member 1002. The eyelets 1012 can be configured, for example, to receive a lace member of an article.

Referring again to FIG. 25, each of the lace-receiving members 1004 can also include one or more apertures 1014 (e.g., two in the illustrated embodiment). The apertures 1014 can be configured for receiving a grip member and/or one or more spacer members (e.g., similar to the grip member 154 and the spacer members 156 shown in FIG. 5).

Figure 27:
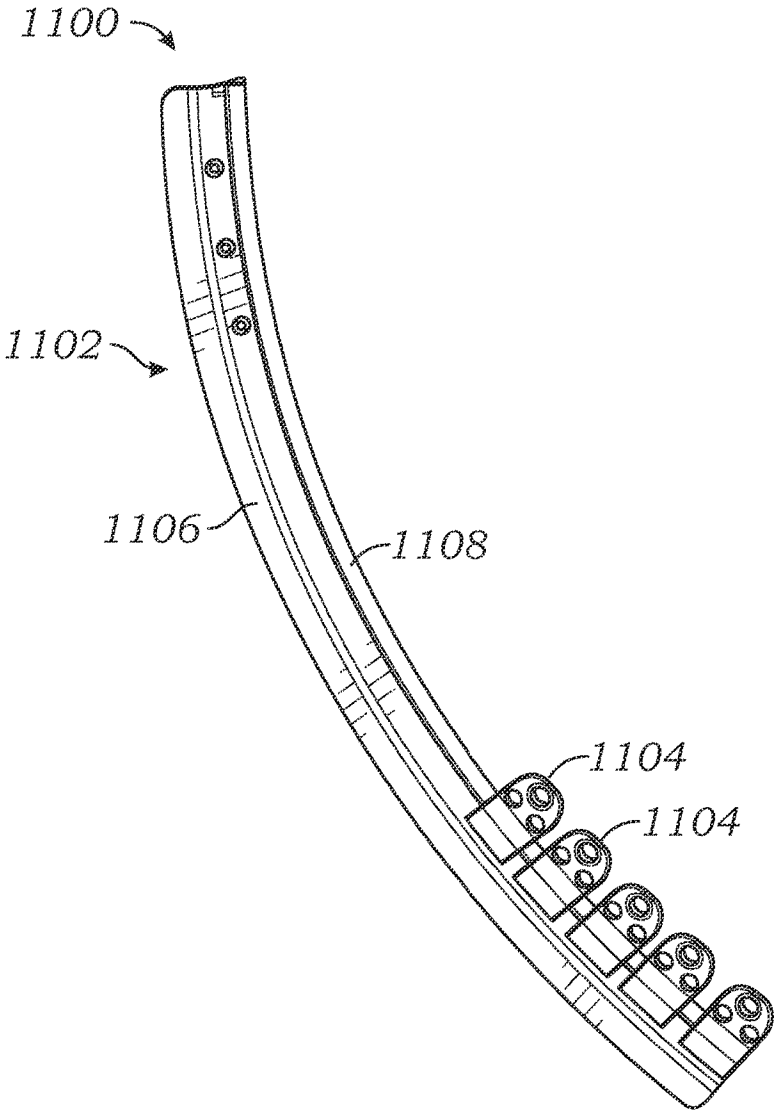
FIG. 27 is a side view of another exemplary closure system.

FIG. 27 shows an exemplary embodiment of a closure system 1100, which can be used, for example, with an article of footwear. The closure system 1100 can comprise one or more support members 1102 (one shown for purposes of illustration) and a plurality of lace-receiving members 1004 (e.g., five shown in the illustrated embodiment) movably (e.g., slidably) coupled to the support member 1102. The support member 1102 and the lace-receiving members 1104 of the closure system 1100 can, for example, be configured similar to the support members 116, 118 and the lace-receiving members 120, 122 of the closure system 110, respectively.

The support member 1102 can include a base 1106 and a rail 1108. In some embodiments, the support member 1102 can be curved. This can be accomplished in various ways.

In some embodiments, the support member 1102 can be formed in a curved configuration. This can be accomplished, for example, by molding (e.g., injection molding) the support member 1102 in the curved configuration.

In other embodiments, the support member 1102 can be formed in a straight configuration and then bent or folded from the straight configuration to a curved configuration. In some such embodiments, the rail 1108 of the support member 1102 can comprise one or more circumferentially-extending notches (not shown, but see notches 1216 shown in FIG. 28) formed on the inside of the curve to prevent or reduce "kinking" and/or material of the rail 1108 from flaring radially outwardly, which may interfere with the lace-receiving members 1104 sliding on the rail 1108.

In still other embodiments, the support member 1102 can be formed from a flexible material that can conform to a various straight and/or curved configurations.

In yet other embodiments, the rail 1108 can comprise a plurality of segments arranged end-to-end. To achieve a curved configuration, the segments can be offset or angled (e.g., non-coaxial) relative to adjacent segments.

In certain embodiments, the curvature of the support member 1102 can, for example, follow the curvature of an upper of the article adjacent a tongue of the article. A curved support member 1102 can be particularly advantageous, for example, with high-top shoes and/or boots where a first portion of the upper has a relatively horizontal orientation (e.g., near a throat of the upper) and a second portion of the upper has a relatively vertical orientation (e.g., near the collar of the upper).

Figure 28:
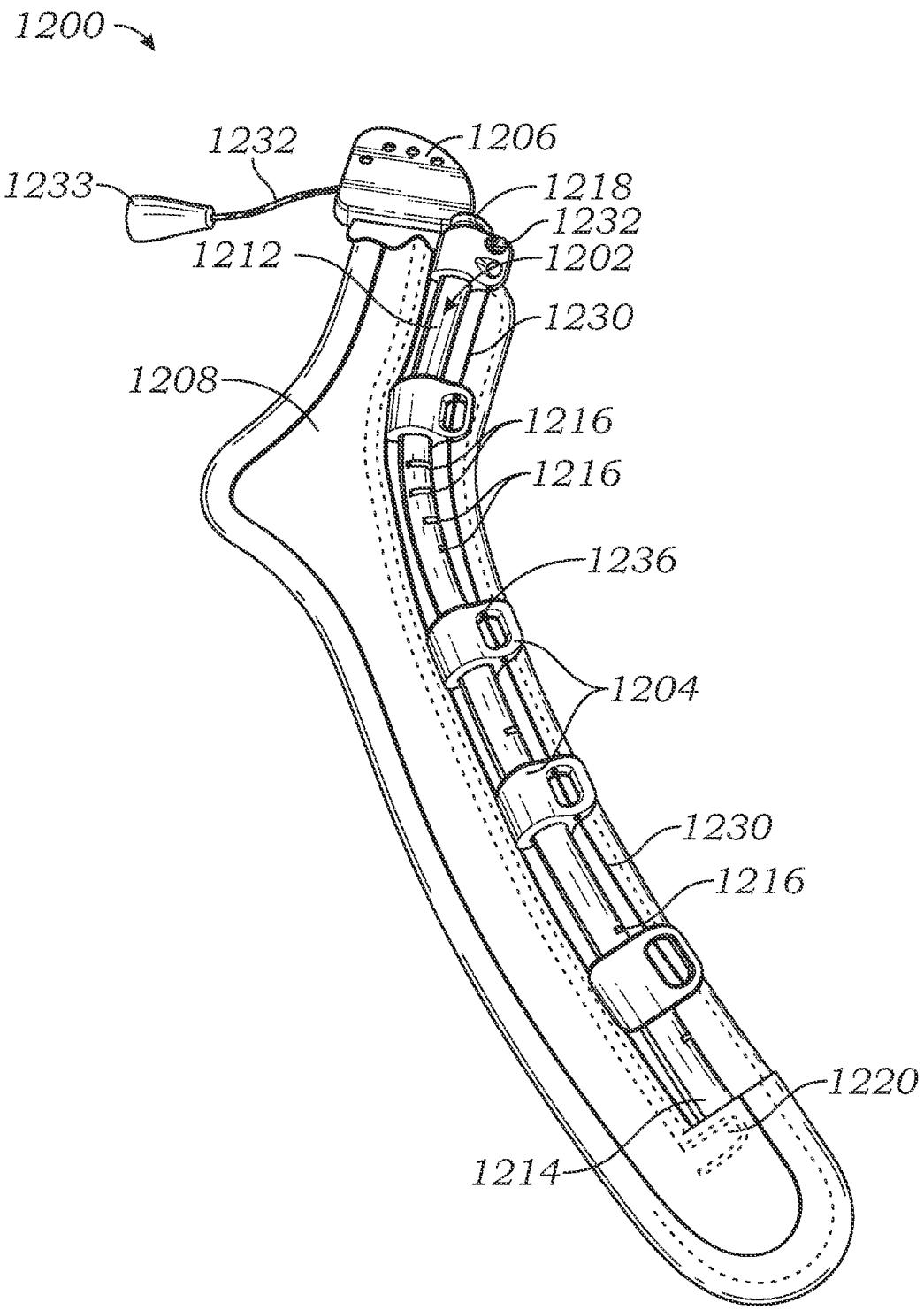
FIG. 28 is a perspective view of another exemplary closure system.

FIGS. 28-31 show an exemplary embodiment of a closure system 1200 and its components. Referring to FIG. 28 (which for purposes of illustration shows only one side of the closure system 1200), the closure system 1200 can include a support member 1202, a plurality of lace-receiving members 1204, a locking member 1206, and a cover 1208. The lace-receiving members 1204 can be movably (e.g., slidably) coupled to the support member 1202. The locking member 1206 can be coupled to or disposed adjacent the support member 1202 and configured for retaining the position of the lace-receiving members 1204 relative to the support member 1202. The cover 1208 can be coupled to the support member 1202 and/or the locking member 1206 and can be configured for coupling the closure system 1200 to an article of footwear and/or at least partially concealing the closure system 1200. Each of these components is further described below.

Referring still to FIG. 28, the support member 1202 can comprise a rail 1210. In some embodiments, the rail 1210 can be directly coupled to an upper of an article and/or to the cover 1208. This can be accomplished, for example, by coupling the rail 1210 to the upper and/or the cover 1208 with adhesive, fasteners, stitching, and/or other suitable means for coupling. It can also be accomplished by forming (e.g., molding or injecting) the rail 1210 on the upper and/or the cover 1208. Additionally or alternatively, the support member 1202 can also include a base and/or a flange to which the rail 1210 is coupled. The base and/or the flange can be coupled to the upper and/or the cover 1208.

Figure 29:
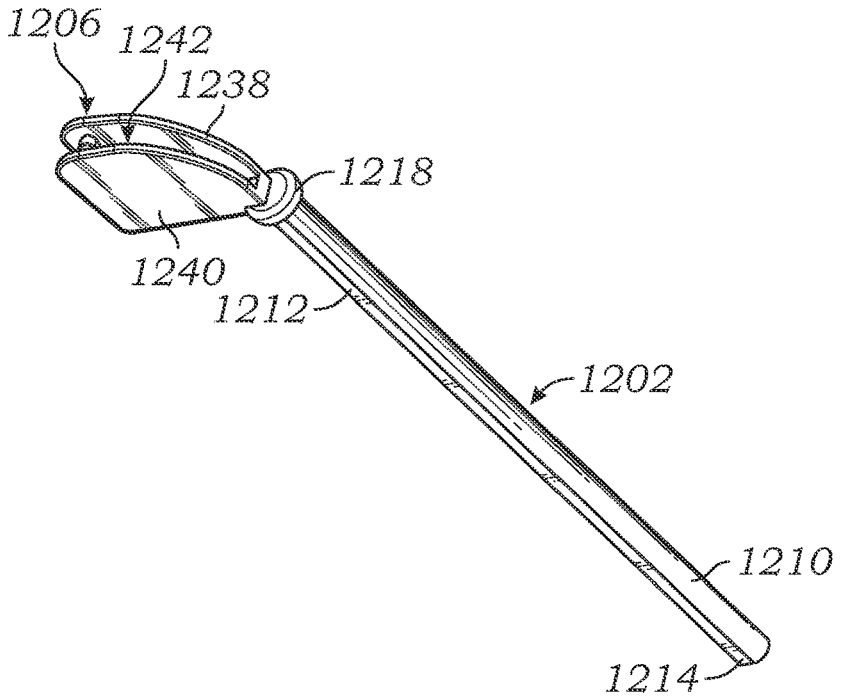
FIG. 29 is a perspective view of a support member and a locking member of the closure system of FIG. 28.

Referring to FIG. 29, the rail 1210 can be elongate and extend from a first end portion 1212 to a second end portion 1214. The rail 1210 can have various cross-sectional profiles (e.g., circular, ovular, D-shaped) taken in a plane perpendicular to a longitudinal axis of the rail 1210.

The rail 1210 can be formed in a straight configuration (e.g., FIG. 29) and bent or folded from the straight configuration to a curved configuration (e.g., FIG. 28). As shown in FIG. 28, in some embodiments, the rail 1210 can comprise one or more circumferentially-extending notches 1216 formed on the inside of the curve to prevent or reduce "kinking" and/or material of the rail 1210 from flaring radially outwardly, which may interfere with the lace-receiving members 1204 sliding on the rail 1210.

A stopper or flange 1218 can be coupled to and extend radially outwardly from the first end portion 1212 of the rail 1210. The flange 1218 can be configured to limit axial movement of the lace-receiving members 1204 along the rail 1210. For example, the flange 1218 can prevent the lace-receiving members 1204 from sliding off the first end portion 1212 of the rail 1210. In some embodiments, the flange 1218 and the rail 1210 can be integrally formed as a single piece. In other embodiments, the flange 1218 and the rail 1210 can be formed as separate pieces that are coupled together with a suitable means for coupling (e.g., with adhesive, welding, and/or fasteners).

As shown in FIG. 28, the second end portion 1214 of the rail 1210 can be covered by a pocket or flap 1220 of the cover 1208. In this manner, the flap 1220 acts as a stopper which can, for example, prevent the lace-receiving members 1204 from sliding off the second end portion 1214 of the rail 1210.

In lieu of or in addition to the flap 1220, a stopper or flange (e.g., similar to the flange 1218) can be coupled to and extend radially outwardly from the second end portion 1214 of the rail 1210. For example, the flange can prevent the lace-receiving members 1204 from sliding off the second end portion 1214 of the rail 1210.

Figure 31:
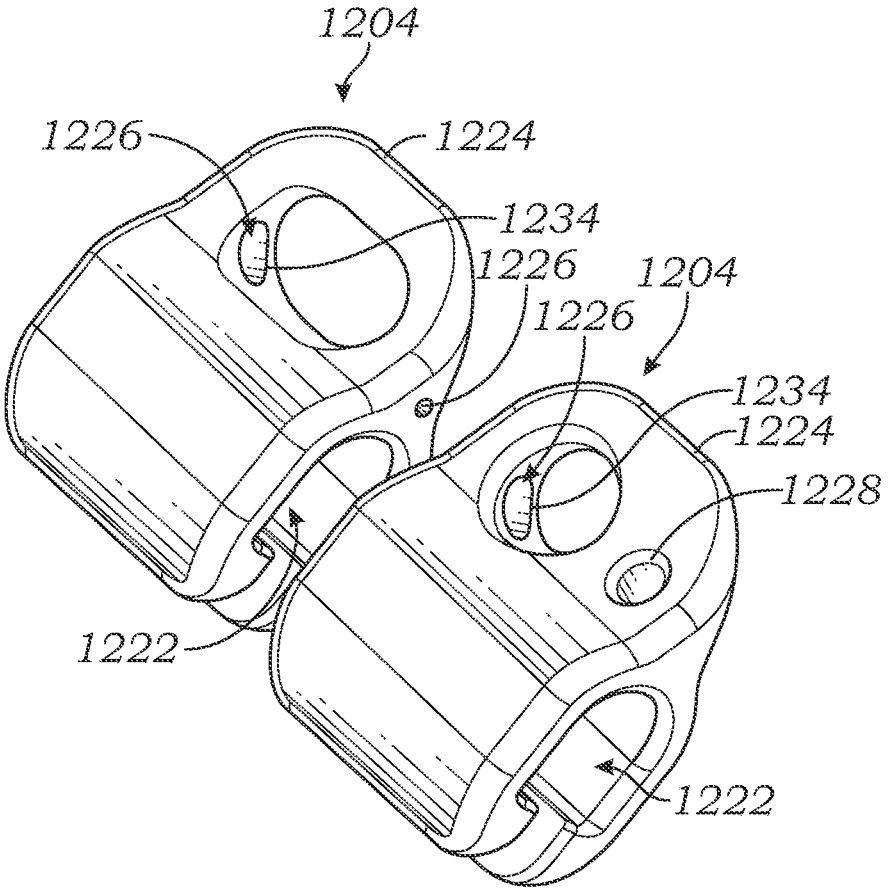
FIG. 31 is a perspective view of two lace-receiving members of the closure system of FIG. 28.

Referring to FIG. 31, each of the lace-receiving members 1204 can comprise a groove 1222 and an eyelet 1224. The groove 1222 can extend axially through the lace-receiving member 1204 and can be configured to receive the rail 1210. The eyelet 1224 can have a laterally-extending opening configured for receiving a securing member (e.g., a lace, cord, strap, etc.).

The groove 1222 can be configured to matably receive the rail 1210. As such, the groove 1222 can have a cross-sectional profile (e.g., circular, ovular, D-shaped) taken in a plane perpendicular to a longitudinal axis of the groove 1222 that corresponds to and/or mates with the cross-sectional profile of the rail 1210. In this manner, the lace-receiving members 1204 can move (e.g., slide) axially relative to the rail 1210, but lateral movement of the lace-receiving members 1204 is restricted relative to the rail 1210, as further described below.

Referring still to FIG. 31, one or more of the lace-receiving members 1204 can comprise axially-extending, first openings 1226 and/or a laterally-extending, second opening 1228. The first openings 1226 can, for example, be configured for receiving spacer members 1230 (FIG. 28), which are disposed between each adjacent pair of lace-receiving members 1204. Other suitable spacer members, such as those described here with respect to other embodiments, can be used. The second opening 1228 can, for example, be configured for receiving a grip member 1232 (FIG. 28), which is coupled to an upper-most one of the lace-receiving members 1204. In certain embodiments, the grip member 1232 can have a knob 1233 coupled thereto. Other suitable grip members, such as those described herein with respect to other embodiments, can be used.

The spacer members 1230 can be configured to provide a predetermined amount of spacing between each adjacent lace-receiving member 1204. The spacer members 1230 can be formed from a flexible material (e.g., a flexible cord or string) so as to allow relative axial movement between the lace-receiving members 1204 when the spacer members 1230 are slacken and to restrict relative axial movement between the lace-receiving members 1204 when the spacer members 1230 are taut. In some embodiments, the predetermined amount of spacing between each of the lace-receiving members 1204 is equal or substantially equal when the spacer members 1230 are taut. In other embodiments, the predetermined amount of spacing between one pair of lace-receiving members 1204 is different than the predetermined amount of spacing between one or more other pairs of lace-receiving members 1204.

In some embodiments, there can be a single spacer member 1230 that is coupled to and extends from each lace-receiving member 1204. In other embodiments, there can be a plurality of spacer members 1230, and each spacer member 1230 can be coupled to and extend between one or more adjacent lace-receiving members 1204.

In certain embodiments, the closure system 1200 can comprise retention members 1236 (FIG. 28) that couple the spacer members 1230 to the lace-receiving members 1204. In some embodiments, the retention members 1236 can be integrally formed with the spacer members 1230 (e.g., a knot formed in the spacer member 1230). In other embodiments, the retention member 1230 can be separately formed pieces that are coupled to the spacer members 1230 (e.g., ferrules). Alternatively or additionally, the retention members 1236 can include adhesive configured to couple the spacer member 1230 to the lace-receiving members 1204.

In some embodiments, the lace-receiving members 1204 can comprise recesses 1234 formed in the inwardly-facing surface of the eyelet 1224 (i.e., adjacent the first openings 1226), as shown in FIG. 31. The recesses 1234 can be configured, for example, to receive the retention members 1236. In particular embodiments, the retention members 1236 have a diameter that is larger than the first openings 1226 of the lace-receiving members 1204 and smaller than the recesses 1234 of the lace-receiving members 1204. In this manner, the retention members 1236 can, for example, prevent the end portions of the spacer members 1230 from "pulling-through" the first openings 1226. The retention members 1236 can nest within the recesses 1234, for example, to prevent (or reduce the likelihood that) the retention members 1236 will interfere with the securing member (e.g., a lace) and/or to at least partially conceal the retention members 1236 (e.g., for improved aesthetics).

The lace-receiving members 1204 can also comprise a recess circumscribing the second opening 1228. The recess can be configured for receiving a retention member that is coupled to the grip member 1232.

As mentioned above, the locking member 1206 can be configured for retaining the position of the lace-receiving members 1204 relative to the support member 1202. Referring again to FIG. 29, the locking member 1206 can comprise a first side portion 1238 and a second side portion 1240. The first and second side portions 1238, 1240 can be coupled together such that there is a notch 1242 formed between the first and second side portions 1238, 1240. The grip member 1232 can be disposed and retained within the notch 1242.

In some embodiments, the notch 1242 can be V-shaped with a wide, upper portion and a narrow, lower portion. The upper portion of the notch 1242 can be configured such that the grip member 1232 can be positioned in the notch 1242. The grip member 1232 can then be pulled downwardly from the upper portion of the notch 1242 toward the lower portion of the notch 1242. The lower portion of the notch 1242 can be sized and configured such that the first and second side portions 1238, 1240 engage the grip member 1232 (e.g., with an interference-type fit) such that the grip member 1232 is clamped or wedged between the first and second side portions 1238, 1240, as shown in FIG. 28. As such, the locking member 1206 retains the position of the grip member 1232, and thus the lace-receiving members 1204 which are coupled to the grip member 1232, relative to the support member 1202.

The grip member 1232 can be released from the locking member 1206 by pulling the grip member 1232 upwardly. This causes the grip member 1232 to disengage the first and second side portions 1238, 1240 and allows the grip member 1232 to move relative to the locking member 1206. As a result, the lace-receiving members 1204 can move relative to the support member 1202.

Figure 30:
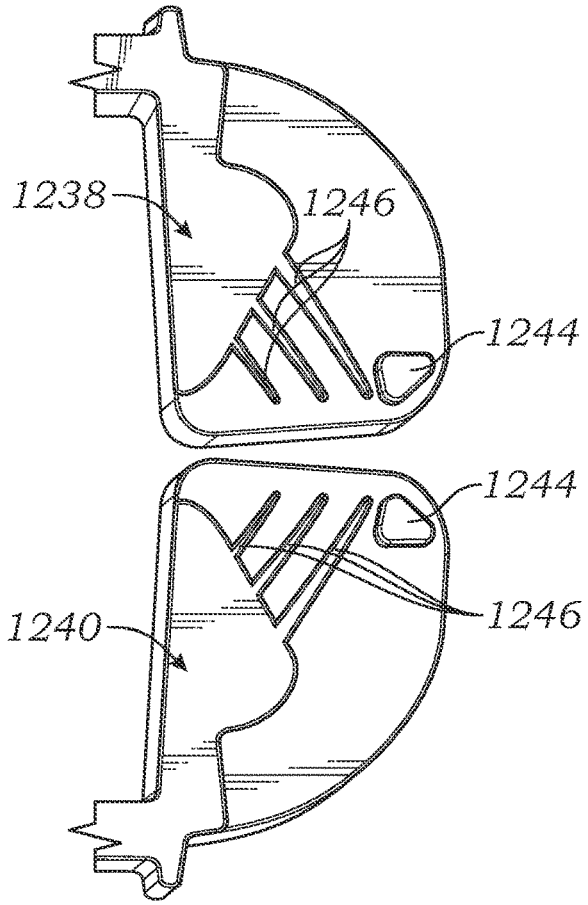
FIG. 30 is an exploded view the locking member of FIG. 29.

In some embodiments, the locking member 1206 can comprise features (e.g., projections) that improve the frictional engagement between the first and second side portions 1238, 1240 and the grip member 1232 and/or to provide feedback to the wearer that the grip member 1232 is secured within the locking member 1206. For example, as shown in FIG. 30 (which shows the first and second side portions 1238, 1240 separated from each other), the first and/or second side portions 1238, 1240 can have projections (e.g., nubs 1244 and/or ridges 1246) extending outwardly into the notch 1242 (FIG. 30). The nubs 1244 and ridges 1246 can engage the grip member 1232 and improve the frictional engagement between the first and second side portions 1238, 1240 and the grip member 1232. In some embodiments, the wearer can hear and/or feel a "click" as the grip member 1232 passes between the nubs 1244 and/or the ridges 1246, which can, for example, provide audible and/or tactile feedback that the grip member 1232 is secured within the locking member 1206.

In particular embodiments, the locking member 1206 can be coupled to the support member 1202. The locking member 1206 and the support member 1202 can be integrally formed as a single piece, as shown in the illustrated embodiment. In other embodiments, the locking member 1206 and the support member 1202 can be formed as separate components that are coupled together. In certain embodiments, the locking member 1206 and the support member 1202 can be formed as separate components which are not coupled together (at least not directly), and the locking member 1206 can be disposed adjacent the support member 1202 (e.g., near a collar of an article of footwear).

Figure 32:
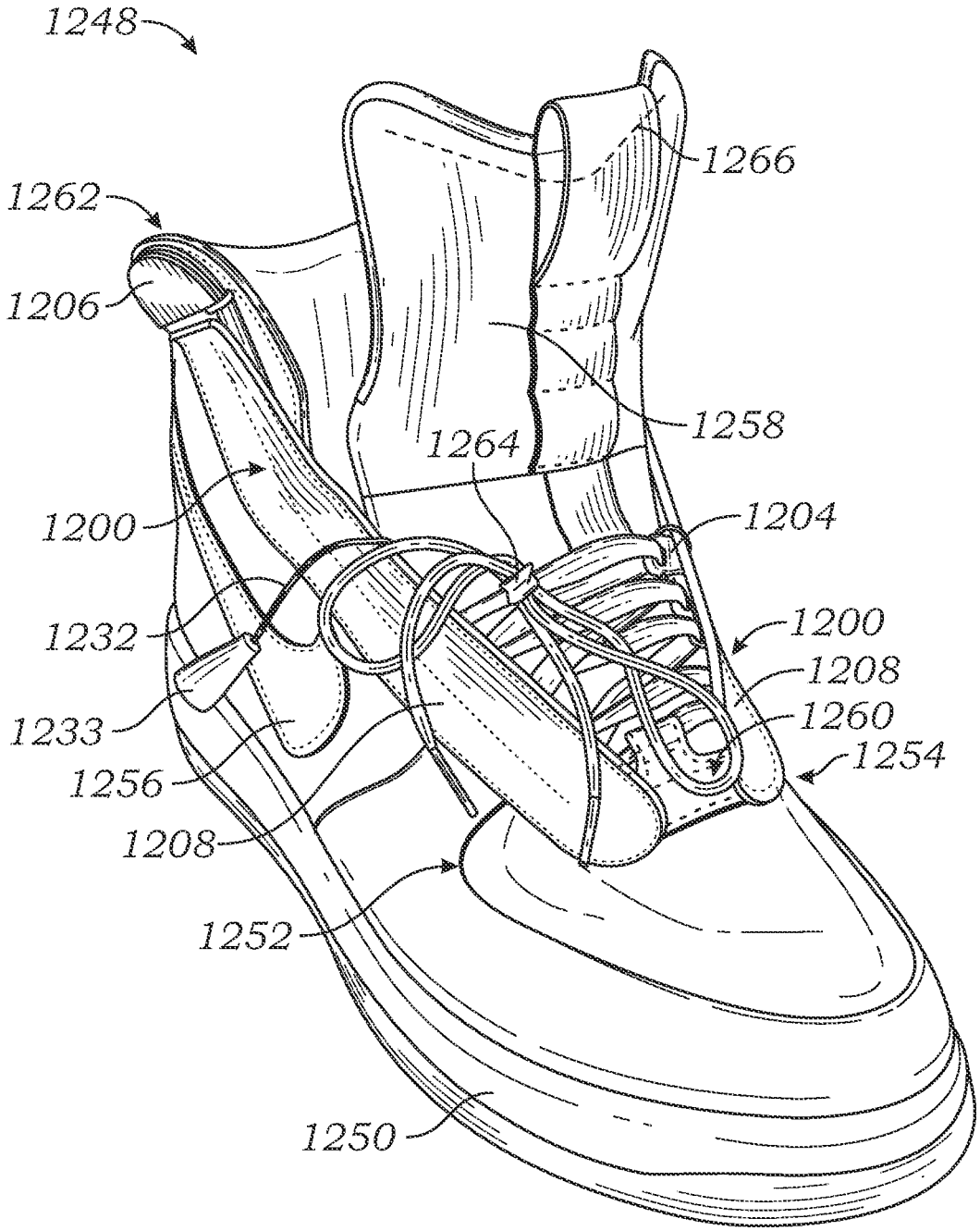
FIG. 32 is a perspective view of an exemplary article of footwear comprising the closure system of FIG. 28 shown in an open configuration.
Figure 33:
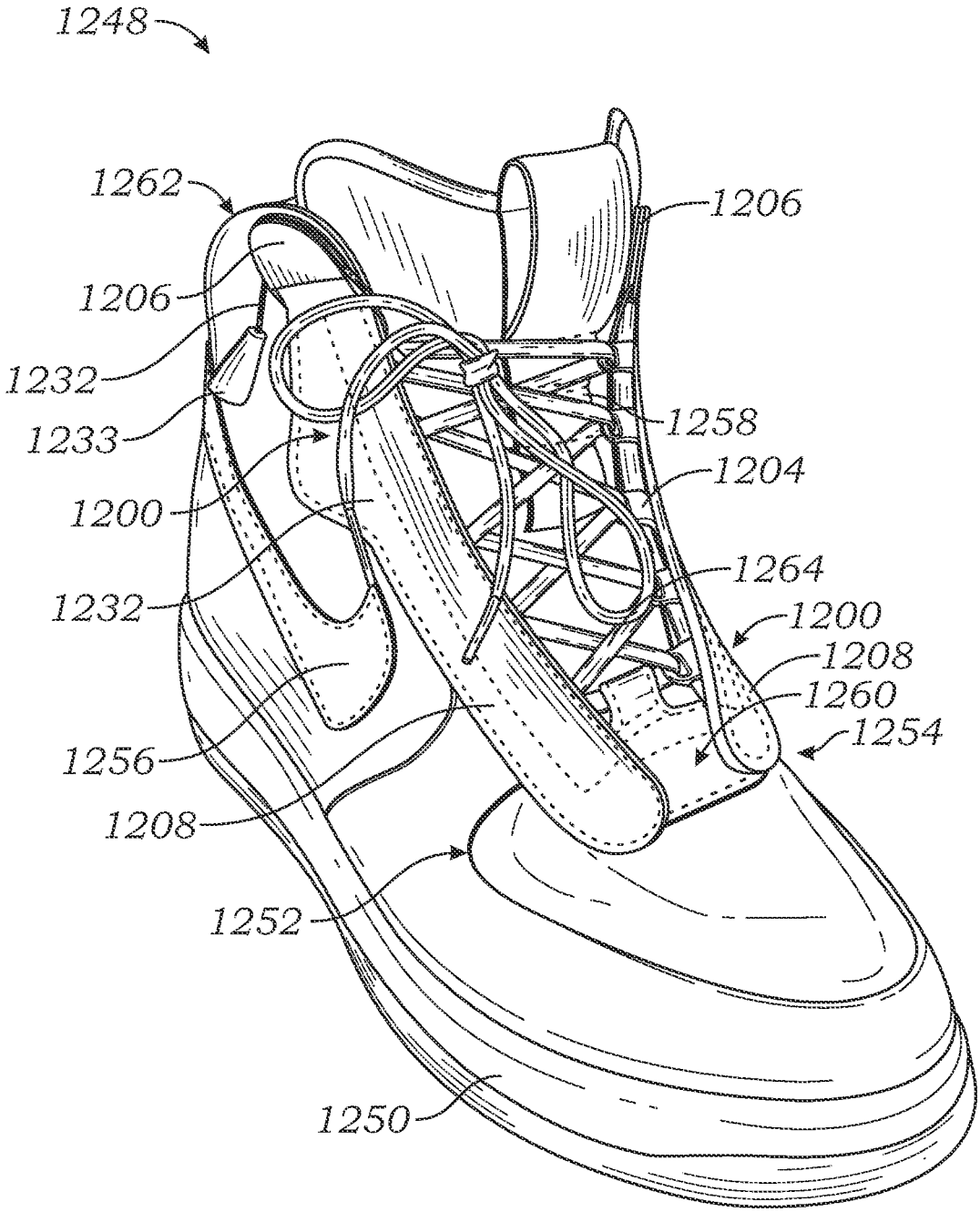
FIG. 33 is a perspective view of the article of footwear of FIG. 32 with the closure system shown in a closed configuration.

FIGS. 32-33 show an exemplary embodiment of an article of footwear 1248 comprising the closure system 1200. Referring to FIG. 32, the article 1248 can comprise a sole structure 1250 and an upper 1252 coupled to the sole structure 1250. The upper 1252 can comprise a medial side 1254, a lateral side 1256, a tongue 1258, a throat 1260, and a collar 1262.

The closure system 1200 can be coupled to the medial and lateral sides 1254, 1256 adjacent the tongue 1258 from a first location (e.g., adjacent the throat 1260) to a second location (e.g., adjacent the collar 1262). In other words, in certain embodiments, the closure system 1200 can be coupled to the medial and lateral sides 1254, 1256 at a location similar to the location in which lace eyelets are typically disposed on an article.

Although partially concealed by the covers 1208 in FIGS. 32-33, in the illustrated embodiment, the closure system 1200 comprises two rails 1210 (i.e., one rail 1210 on the medial side 1254 and one rail 1210 on the lateral side 1256) and five pairs of lace-receiving members 1204. A lace member 1264 can be threaded through and interconnect each of the lace-receiving members 1204.

FIG. 32 shows the closure system 1200 in an open configuration. In the open configuration, the grip members 1232 are released from the locking members 1206. This allows the lace-receiving members 1204 to slide on the rails 1210 pulling the lace member 1264 away from the collar 1262 and toward the throat 1260 of the article 1248. With the lace member 1264 slackened and/or out of the way of the tongue 1258, the tongue 1258 can move and/or be moved forward (e.g., away from the wearer's foot and/or toward the toe) and the medial and lateral sides 1254, 1256 and the collar 1262 can spread apart. As a result, a wearer can insert and/or withdraw their foot from the article 1248 relatively easily when the closure system is in the open configuration.

In some embodiments, one or more portions of the article 1248 can be biased toward the open configuration. For example, the collar 1262 can be biased to flare outwardly (e.g., circumferentially and/or radially) to the open configuration. Additionally or alternatively, the tongue 1258 can, for example, be biased to a forward and/or a folded configuration (e.g., a U-shaped or V-shaped configuration, e.g., shown by V-shaped dashed line 1266). Biasing the article 1248 to the open configuration can be accomplished in various ways.

For example, in some embodiments, biasing members (e.g., elastic bands or cords) can be used to bias the collar 1262 and/or the tongue 1258 in the open configuration. In one particular embodiment, an elastic band can be coupled to the tongue 1258 and to the throat 1260 to bias the tongue forward. In another embodiment, an elastic band can be coupled to opposing sides of the tongue 1258 to bias the tongue to the folded configuration.

Additionally or alternatively, the collar 1262 and/or the tongue 1258 can have internal structural members such as elastically deformable plates or other members that are shape set to the open configuration. For example, in certain embodiments, the tongue 1258 can have a elastically deformable plate that is shape set in the forward and/or folded configuration.

Further or alternatively, the manner in which the article is assembled (e.g., stitched, fastened, and/or adhered) can be configured to bias the collar 1262 to the open configuration and/or to bias the tongue 1258 to the forward and/or folded configurations.

Biasing the article 1248 in the open configuration can, for example, allow the wearer to more easily insert or withdraw their foot from the article 1248 because the tongue 1258 moves forward out of the way and the collar 1262 opens up, thus enlarging the opening through which the wearer can insert and/or withdraw their foot. It can, for example, also allow the wearer to more easily actuate the closure system 1200 from the open configuration (FIG. 32) to a closed configuration (FIG. 33) because the folded configuration of the tongue 1258 and the open configuration of the collar 1262 tends to self-align or nest the tongue 1258 between the medial and lateral sides 1254, 1256 and the collar 1262 as the closure system 1200 is moved from the open configuration to the closed configuration.

To move the closure system 1200 from the open configuration (FIG. 32) to the closed configuration (FIG. 33), the wearer can grab the knobs 1233 and pull the grip member 1232 upwardly. This in turn causes at least some of the lace-receiving members 1204 to move toward the first end portions 1212 of the rails 1210 and the lace-receiving members 1204 to spread apart relative to each other. As a result, the lace member 1264 moves over a greater portion of the tongue 1258, which pulls the tongue 1258 back against the wearer's foot. The lace member 1264 also tightens, which draws together the medial and lateral sides 1254, 1256 and causes the collar 1262 to contract around the tongue 1258 and the wearer's foot.

The wearer can adjust the closure system 1200 to one or more intermediate configurations between a fully closed configuration and a fully open configuration, for example, by varying the spacing between the lace-receiving members 1204 along the rails 1210. For a tighter and/or more secure fit, the wearer can increase the spacing between the lace-receiving members 1204. For a looser and/or less secure fit, the wearer can decrease the spacing between the lace-receiving members 1204.

The wearer can secure the closure system 1200 in the desired configuration by wrapping the grip members 1232 around the locking members 1206 such that the grip members 1232 are disposed in the notches 1242 of the locking members 1206. The wearer can then secure the grip members 1232 within the notches 1242 by pulling the knobs 1233 downwardly so as to clamp or wedge the grip members 1232 between the first and second side portions 1238, 1240 of the locking members 1206.

To move the closure system 1200 from the closed configuration (FIG. 33) to the open configuration (FIG. 32), the wearer can grab the knobs 1233 and pull the grip members 1232 upwardly such that the grip members 1232 withdraw from the notches 1242 of the locking members 1206. This allows the lace-receiving members 1204 to move relative to the rails 1210. The wearer can then slide the lace-receiving members 1204 toward each other and downward toward the second end portions 1214 of the rails 1210. This moves the lace member 1264 downward and allows the tongue 1258 and/or the collar 1262 to move or to be moved forward away from the wearer's foot, thus allowing the wearer to withdraw their foot from the article 1248.

In certain embodiments, a closure system (e.g., the closure system 1200) can have an automated (e.g., electronic) drive mechanism configured for adjusting the positioning of the lace-receiving members and/or the lace member. For example, the closure system can include an electric motor coupled to a spool, reel, or other component that is coupled to the grip member (e.g., the grip member 1232). In one particular embodiment, actuating the electric motor (automatically or manually) can move the grip member (and thus the lace-receiving members and lace member) relative to the spool, reel, etc. to customize the tension of the lace member.

The closure systems described herein can, for example, make an article of footwear significantly easier to put on and/or take off than typical lacing systems, while still maintaining the appearance of a traditional lace-up article of footwear. The disclosed closure systems can, for example, also allow a wearer to customize the fit and/or feel of the article of footwear. For example, the closure system can be configured for a more secure fit (e.g., for performance) by tightening the closure system and/or for a relatively more relaxed fit (e.g., for casual use) by loosening the closure system.

The technologies from any example can be combined with the technologies described in any one or more of the other examples. For example, one or more of the technologies described with respect to the locking member 200 can be combined with one or more of the technologies described with respect to the locking member 400, or vice versa. As another example, the technologies of the closure system 1200 can be combined with one or more of the technologies of the closure system 110, or vice versa.

In view of the many possible embodiments to which the principles of the disclosure may be applied, it should be recognized that the illustrated embodiments are only preferred examples and should not be taken as limiting the scope of the claims. Rather, the scope of the claimed subject matter is defined by the following claims and their equivalents.

The invention claimed is:

1. An article of footwear, comprising:

a medial portion;

a medial support member coupled to the medial portion, wherein the medial support member comprises a first rail;

a lateral portion;

a lateral support member coupled to the lateral portion, wherein the lateral support member comprises a second rail;

a plurality of first lace-receiving members disposed on and movable along the first rail of the medial support member to move the article of footwear between an open configuration and a closed configuration;

a plurality of second lace-receiving members disposed on and movable along the second rail of the lateral support member to move the article of footwear between the open configuration and the closed configuration;

a lace member extending between the plurality of first lace-receiving members and the plurality of second lace-receiving members;

a first grip member extending from an upper-most first lace-receiving member of the plurality of first lace-receiving members, the first grip member comprising a fixed end and a free end, the fixed end of the first grip member coupled to the upper-most first lace-receiving member;

a second grip member extending from an upper-most second lace-receiving member of the plurality of second lace-receiving members, the second grip member comprising a fixed end and a free end, the fixed end of the second grip member coupled to the upper-most second lace-receiving member, wherein the second grip member is separate and spaced apart from the first grip member; and first and second locking members configured for securing the article of footwear in the closed configuration, wherein each of the first and second locking members comprises a first side portion and a second side portion forming a notch therebetween, wherein the notch of the first locking member is configured to receive and releasably secure the first grip member relative to the first rail thereby locking the plurality of first lace-receiving members relative to the first rail, wherein the notch of the second locking member is configured to receive and releasably secure the second grip member relative to the second rail thereby locking the plurality of second lace-receiving members relative to the second rail, wherein the notch of each of the first and second locking members comprises a V-shape with a wider upper portion oriented toward an upper-most edge of the article of footwear and a narrower lower portion, wherein the wider upper portion is configured for receiving a respective grip member of the first and second grip members, and wherein the narrower lower portion is configured for releasably securing the respective grip member of the first and second grip members within the notch.

2. The article of footwear of claim 1, wherein the first and second side portions of each of the first and second locking members comprises projections extending therefrom into the notch and configured for engaging a respective grip member of the first and second grip members.

3. The article of footwear of claim 1, further comprising a first cover and a second cover, wherein the first cover extends from the medial portion toward the lateral portion and covers the first rail, and wherein the second cover extends from the lateral portion toward the medial portion and covers the second rail.

4. The article of footwear of claim 3, wherein the first locking member is exposed from the first cover, and wherein the second locking member is exposed from the second cover.

5. The article of footwear of claim 1, further comprising a throat, a tongue, and a collar, wherein the throat extends between a lower section of the medial portion and a lower section of the lateral portion, wherein the tongue extends from the throat between the medial portion and the lateral portion, and wherein the collar extends from an upper section of the medial portion to an upper section of the lateral portion.

6. The article of footwear of claim 5, further comprising a biasing member extending from the tongue to the throat and configured to move the tongue forward away from the collar when the article of footwear is in the open configuration.

7. The article of footwear of claim 5, further comprising a biasing member coupled to the collar and configured to expand the collar when the article of footwear is in the open configuration.

8. The article of footwear of claim 5, further comprising an elastically deformable plate disposed in the tongue and configured to retain the tongue in a folded configuration when the article of footwear is in the open configuration.

9. The article of footwear of claim 8, wherein the folded configuration comprises a V-shape.

10. The article of footwear of claim 8, wherein the folded configuration comprises a U-shape.

11. The article of footwear of claim 5, further comprising an elastically deformable plate disposed in the collar and configured to expand the collar when the article of footwear is in the open configuration.

12. An article of footwear comprising:

a medial portion;

a medial support member coupled to the medial portion, wherein the medial support member comprises a first rail;

a lateral portion;

a lateral support member coupled to the lateral portion, wherein the lateral support member comprises a second rail;

a plurality of first lace-receiving members disposed on and movable along the first rail of the medial support member to move the article of footwear between an open configuration and a closed configuration;

a plurality of second lace-receiving members disposed on and movable along the second rail of the lateral support member to move the article of footwear between the open configuration and the closed configuration;

a lace member extending between the plurality of first lace-receiving members and the plurality of second lace-receiving members;

a grip member comprising a fixed end and a free end, the fixed end coupled to an upper-most first lace-receiving member of the plurality of first lace-receiving members or to an upper-most second lace-receiving member of the plurality of second lace-receiving members; and a locking member configured for securing the article of footwear in the closed configuration, wherein the locking member comprises a first interior side portion and a second interior side portion forming a notch therebetween, wherein the notch of the locking member is configured to receive the grip member, and wherein the first interior side portion or the second interior side portion comprise one or more projections extending into the notch and configured for engaging and retaining the grip member within the notch.

13. The article of footwear of claim 12, wherein the notch of the locking member comprises a V-shape with a wider upper portion oriented toward an upper: most edge of the article of footwear and a narrower lower portion, wherein the wider upper portion is configured for receiving the grip member, and wherein the narrower lower portion is configured for securing the grip member relative to the notch.

14. The article of footwear of claim 12, wherein the first interior side portion and the second interior side portion of the locking member each comprise a plurality of projections extending therefrom and configured for engaging the grip member.

15. An article of footwear comprising:

a medial portion;

a medial support member coupled to the medial portion, wherein the medial support member comprises a first rail;

a lateral portion;

a lateral support member coupled to the lateral portion, wherein the lateral support member comprises a second rail;

a throat extending between a lower section of the medial portion and a lower section of the lateral portion;

a tongue extending from the throat between the medial portion and the lateral portion;

a collar extending from an upper section of the medial portion to an upper section of the lateral portion;

a plurality of first lace-receiving members disposed on and movable along the first rail of the medial support member to move the article of footwear between an open configuration and a closed configuration;

a plurality of second lace-receiving members disposed on and movable along the second rail of the lateral support member to move the article of footwear between the open configuration and the closed configuration;

a lace member extending across the tongue and between the plurality of first lace-receiving members and the plurality of second lace-receiving members;

a grip member comprising a fixed end and a free end, the fixed end coupled to one of the plurality of first lace-receiving members or the plurality of second lace-receiving members;

a locking member configured for securing the article of footwear in the closed configuration, wherein the locking member comprises a first interior side portion and a second interior side portion forming a notch therebetween, wherein the notch of the locking member is configured to receive the grip member, and wherein the first interior side portion or the second interior side portion engage and retain the grip member within the notch; and a biasing member extending from the tongue to the throat and configured to move the tongue forward away from the collar when the article of footwear is in the open configuration.

16. The article of footwear of claim 15, further comprising an elastically deformable plate disposed in the tongue and configured to retain the tongue in a folded configuration when the article of footwear is in the open configuration.

17. The article of footwear of claim 16, wherein the tongue comprises a V-shape in the folded configuration.

18. The article of footwear of claim 16, wherein the tongue comprises a U-shape in the folded configuration.

19. The article of footwear of claim 15, further comprising an elastically deformable plate disposed in the collar and configured to expand the collar when the article of footwear is in the open configuration.

* * * * *